US012173419B2

(12) United States Patent
Petitjean et al.

(10) Patent No.: US 12,173,419 B2
(45) **Date of Patent: *Dec. 24, 2024**

(54) APPARATUS AND METHOD FOR OPERATING AN ELECTROLYTIC CELL

(71) Applicant: ELYSIS LIMITED PARTNERSHIP, Montreal (CA)

(72) Inventors: Bruno Petitjean, Coublevie (FR); Alain Noizet, Grenoble (FR); Benoit Bardet, Saint-Etienne de Cuines (FR)

(73) Assignee: ELYSIS LIMITED PARTNERSHIP, Montreal (CA)

( * ) Notice: Subject to any disclaimer, the term of this patent is extended or adjusted under 35 U.S.C. 154(b) by 308 days.

This patent is subject to a terminal disclaimer.

(21) Appl. No.: 17/680,536

(22) Filed: Feb. 25, 2022

(65) Prior Publication Data

US 2022/0275529 A1 Sep. 1, 2022

Related U.S. Application Data

(63) Continuation of application No. PCT/CA2020/051173, filed on Aug. 27, 2020.
(Continued)

(51) Int. Cl.
*C25C 3/10* (2006.01)
*C25C 3/12* (2006.01)
(Continued)

(52) U.S. Cl.
CPC ..... *C25C 3/12* (2013.01); *C25C 3/10* (2013.01); *C25C 3/125* (2013.01); *C25C 3/18* (2013.01);
(Continued)

(58) Field of Classification Search
None
See application file for complete search history.

(56) References Cited

U.S. PATENT DOCUMENTS 3,852,173 A * 12/1974 Jacobs ..... C25C 3/06 205/394
3,956,676 A 5/1976 Vierow et al.
(Continued)

FOREIGN PATENT DOCUMENTS

CN 1688750 A 10/2005
CN 102234819 A 11/2011
(Continued)

OTHER PUBLICATIONS

International Search Report for corresponding PCT/CA2020/051173 dated Nov. 26, 2020.
(Continued)

*Primary Examiner* — Harry D Wilkins, III
(74) *Attorney, Agent, or Firm* — Gowling WLG (Canada) LLP; Damien Calvet

(57) ABSTRACT

An apparatus, also named transfer box or TB, for conveying an anode assembly outside of an electrolyte cell is described. An apparatus, also named cell preheater lifting beam or CPLB, for conveying an anode assembly or a cell pre-heater outside of an electrolyte cell is also disclosed. TB and CPLB are conjointly used for starting up the electrolytic cell or for replacing a spent anode assembly while maintaining the production of non-ferrous metal, such as aluminum or aluminium. The thermal insulation of the TB allows maintaining the anode temperature homogeneity and preventing thermal shocks when introducing the inert anodes into the hot electrolytic bath. TN and CPLB allow accurate positioning of anode assemblies or cell-preheaters over the electrolysis cell before achieving mechanical and electrical connections of the anode assembly or the cell pre-heater to the electrolysis cell. Several related methods for the operation of an electrolytic cell are also disclosed.

20 Claims, 24 Drawing Sheets

Related U.S. Application Data

(60) Provisional application No. 62/892,722, filed on Aug. 28, 2019.

(51) Int. Cl.

| | |
|---|---|
| ***C25C 3/18*** | (2006.01) |
| ***C25C 3/34*** | (2006.01) |
| ***C25C 7/02*** | (2006.01) |
| ***C25C 7/06*** | (2006.01) |

(52) U.S. Cl.
CPC ..... *C25C 3/34* (2013.01); *C25C 7/02* (2013.01); *C25C 7/06* (2013.01)

(56) References Cited

U.S. PATENT DOCUMENTS

| | | | | |
|---|---|---|---|---|
| 4,265,717 | A | 5/1981 | Wiltzius | |
| 5,435,897 | A * | 7/1995 | Zannini | C25C 3/06 204/247 |
| 5,876,585 | A * | 3/1999 | Schenk | C25C 3/16 204/279 |
| 7,282,133 | B2 | 10/2007 | Burg et al. | |
| 7,422,675 | B2 | 9/2008 | Acker et al. | |
| 7,677,860 | B2 | 3/2010 | Kivistöet al. | |
| 8,123,914 | B2 | 2/2012 | Hitomi | |
| 8,252,156 | B2 | 8/2012 | Dumont et al. | |
| 8,808,526 | B2 | 8/2014 | Faure et al. | |
| 9,371,594 | B2 | 6/2016 | Guerin et al. | |
| 10,066,309 | B2 | 9/2018 | Wright | |
| 2003/0102228 | A1 | 6/2003 | Nora et al. | |
| 2004/0094409 | A1 | 5/2004 | D'Astolfo et al. | |
| 2011/0194916 | A1 * | 8/2011 | Wattel | C25C 7/08 414/222.01 |
| 2014/0021058 | A1 | 1/2014 | Wright | |

FOREIGN PATENT DOCUMENTS

| | | | | |
|---|---|---|---|---|
| CN | 202081179 | A | 12/2011 | |
| CN | 202081179 | U * | 12/2011 | C25C 3/12 |
| CN | 102747383 | A | 10/2012 | |
| CN | 104246019 | A | 4/2013 | |
| CN | 103255437 | A | 8/2013 | |
| CN | 104694964 | A | 6/2015 | |
| CN | 204608173 | U | 9/2015 | |
| CN | 107513728 | A | 12/2017 | |
| CN | 110129837 | A | 6/2019 | |
| FR | 3016892 | A1 | 7/2015 | |
| WO | WO-2012021924 | A1 * | 2/2012 | C25C 3/08 |
| WO | WO-2012037611 | A1 * | 3/2012 | C25C 3/08 |
| WO | WO 2015/052381 | A1 | 4/2015 | |
| WO | WO 2015/110902 | A1 | 7/2015 | |
| WO | WO 2016/103020 | A1 | 6/2016 | |

OTHER PUBLICATIONS

Search Report dated Jan. 2, 2023 from corresponding DK application No. PA 2022 70065.

Extended European Search Report dated Oct. 23, 2024 from corresponding EP 20856909.5.

* cited by examiner

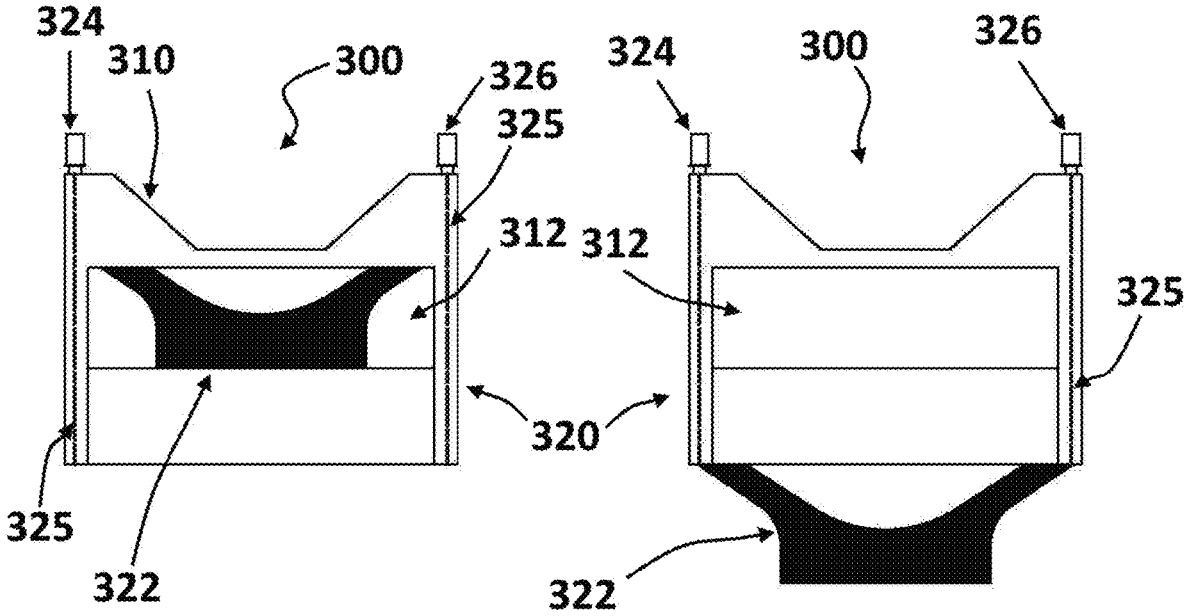
FIG. 20
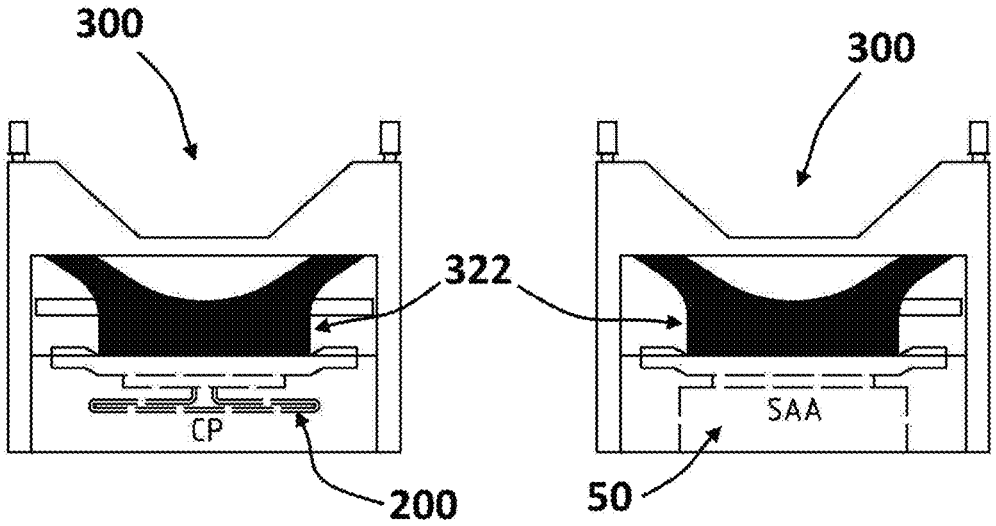
FIG. 21
FIG. 22

APPARATUS AND METHOD FOR OPERATING AN ELECTROLYTIC CELL

CROSS-REFERENCE TO RELATED APPLICATIONS

The present patent application is a continuation of PCT/CA2020/051173 filed on Aug. 27, 2020 which claims the benefits of priority of U.S. Provisional Patent Application No. 62/822,722 filed at the United States Patent and Trademark Office on Aug. 28, 2019, the contents of which are incorporated herein by reference.

TECHNICAL FIELD

The present invention generally relates to systems, apparatus and methods for operating an electrolytic cell, such as the maintenance and replacement of anodes or cell pre-heater of an electrolytic cell, more particularly, but not exclusively, for replacing stable/inert anodes of electrolytic cells, such as for the production of metals, such as, but not limited to aluminum.

BACKGROUND

Aluminum metal, also called aluminium, is produced by electrolysis of alumina, also known as aluminium oxide (IUPAC), in a molten electrolyte at about 750-1000° C. contained in a number of smelting cells. In the traditional Hall-Heroult process, the anodes are made of carbon and are consumed during the electrolytic reaction. The anodes need to be replaced after 3 to 4 weeks.

During experiments, it has been determined that the current systems and processes for maintenance and replacement of anodes of an electrolytic cell are inadequate when inert anodes are used instead of the traditional carbon anodes required in the Hall-Heroult process.

Also, electrolytic cells working with inert anodes need to be pre-heated, typically using a cell pre-heater. The cell pre-heater has to be inserted in the cell before heating the cell and then removed from the cell before introducing pre-heated anodes in the cell.

The present invention at least partly addresses the identified shortcomings when inert anodes are used.

SUMMARY

According to a first aspect, the invention is directed to an insulating apparatus for maintaining and conveying an anode assembly outside of an electrolyte cell. The anode assembly comprises a plurality of vertical inert anodes. The apparatus comprises: a supporting structure, defining an interior spacing, for insulating the anode assembly when in the interior spacing; an actuator assembly coupled with the supporting structure and configured to support the anode assembly, the actuator assembly being operable to move the anode assembly between: an insulated position wherein the anode assembly is positioned in the interior spacing of the supporting structure; and a loading-unloading position wherein the anode assembly is outside the supporting structure for loading the anode assembly to the actuator assembly and unloading the anode assembly from the actuator assembly; and a thermal shelter assembly extending from an interior surface of the supporting structure for insulating the anode assembly when the anode assembly is in the interior spacing.

According to another aspect, the invention is directed to an apparatus for conveying an anode assembly outside of an electrolyte cell. The anode assembly comprises a plurality of anodes, preferably vertical inert anodes. The apparatus comprises: a supporting structure, defining an interior spacing; an actuator assembly coupled with the supporting structure and configured to support the anode assembly, the actuator assembly being operable to move the anode assembly between: an insulated position wherein the anode assembly is positioned in the interior spacing of the supporting structure; and a loading-unloading position wherein the anode assembly is outside the supporting structure for loading the anode assembly to the actuator assembly or unloading the anode assembly from the actuator assembly; and a thermic system assembly supported by the supporting structure for maintaining a temperature of the anode assembly when the anode assembly is in the interior spacing.

According to a preferred embodiment, the actuator assembly further comprises an electrical insulating system for electrically isolating the anode assembly from the actuator assembly.

According to a preferred embodiment, the supporting structure defines an open bottom in communication with the interior spacing, the apparatus further comprising: a door assembly moveably coupled to the supporting structure and operable between an open position to permit movement of the anode assembly between the insulated position and the loading-unloading position, and a closed position where the door assembly closes the open bottom of the supporting structure.

According to a preferred embodiment, the actuator assembly comprises a handling horizontal beam configured to removably connect to the anode assembly and to vertically move the anode assembly inside the interior spacing.

According to a preferred embodiment, the actuator assembly comprises a first motor and a second motor supported by the supporting structure, each motor being respectively coupled to a moving element arranged at opposite longitudinal ends of the handling beam along which the handling beam is vertically raised and lowered. Preferably, the moving element comprises a threaded rod or a chain activated by the motor for raising or lowering the handling beam.

According to a preferred embodiment, the actuator assembly comprises a failsafe hanging device for removably engaging and supporting the anode assembly. Preferably, the failsafe hanging device engages into a corresponding handling pin of the anode assembly upon lowering of the actuator assembly onto the anode assembly.

According to a preferred embodiment, the thermic system comprises several thermal shelters extending from an inner surface of the supporting structure for interfacing with corresponding surfaces of the plurality of inert anodes when the anode assembly is in the interior spacing.

According to a preferred embodiment, the thermal shelters may comprise refractory linings.

According to a preferred embodiment, the apparatus further comprises an electrical heater module for heating the inert anodes when the anode assembly is in the interior spacing.

According to a preferred embodiment, the supporting structure is configured to permit ventilation of an upper zone of the anode assembly to maintain the upper zone at a lower temperature than a lower hot zone containing the plurality of inert anodes.

According to a preferred embodiment, the apparatus further comprises guiding pins which register with a structure of the electrolyte cell for facilitating operative installation of the anode assembly thereinto.

According to a preferred embodiment, the apparatus may further comprise a first electrical isolating element between the guiding pins and the supporting structure.

According to a preferred embodiment, the actuator assembly further comprises an automated connection assembly to electrically connect the anode assembly to the electrolyte cell. Preferably, the automated connection assembly comprises a pneumatic wrench and a synchronized bolting system.

According to a preferred embodiment, the apparatus may further comprise a second electrical isolating element between the automated connection assembly and the supporting structure.

According to a preferred embodiment, the apparatus may further comprise a third electrical isolating element on a top portion of the actuator assembly. According to a preferred embodiment, the supporting structure comprises an attaching element on a top portion which is configured to be mechanically attached to an overhead crane for transporting or conveying the apparatus.

According to a preferred embodiment, the apparatus may further comprise a fourth electrical isolating element for isolating the apparatus from the overhead crane.

According to yet another aspect, the invention is directed to a method for delivering an anode assembly of inert anodes at a given temperature to an electrolytic cell for use in producing a non-ferrous metal, comprising:

preheating the inert anodes of the anode assembly at the given temperature, the anode assembly being located outside the electrolytic cell;

transporting the anode assembly toward the electrolytic cell while maintaining the given temperature of the pre-heated inert anodes; and plunging the pre-heated inert anodes of the anode assembly into a bath of molten electrolyte of the electrolytic cell.

According to a preferred embodiment, a) preheating the inert anodes of the anode assembly is performed into a preconditioning station located at a distance from the electrolytic cell. The method preferably further comprises before b), removing the anode assembly from the preconditioning station while enclosing the anode assembly inside an insulating transportation apparatus configured to convey the anode assembly toward the electrolytic cell while maintaining the given temperatures of the inert anodes within a predetermined tolerance range.

According to a preferred embodiment, removing the anode assembly from the preconditioning station and enclosing the anode assembly in the insulating transportation apparatus comprises:

positioning the insulating transportation apparatus over the anode assembly located in the anode preconditioner;

lowering an actuator assembly from an interior spacing of the insulating transportation apparatus to the anode assembly;

connecting the anode assembly to the actuator assembly; and raising the actuator assembly with the anode assembly connected thereto from the anode assembly preconditioner and into an interior spacing of the insulating transportation apparatus.

According to a preferred embodiment, c) plunging the pre-heated inert anodes of the anode assembly into a bath of molten electrolyte of the electrolytic cell comprises:

positioning the insulating transportation apparatus over the electrolytic cell;

lowering the actuator assembly and the anode assembly from the insulating transportation apparatus into the electrolytic cell until the pre-heated inert anodes are plunged inside the bath of molten electrolyte;

mechanically connecting the anode assembly to the electrolyte cell;

electrically connecting the inert anodes of the anode assembly to the electrolyte cell; and releasing the anode assembly from the actuator assembly.

According to a preferred embodiment, lowering the anode assembly into the bath comprises registering guiding pins of the insulating transportation apparatus to respective receiving apertures of the electrolytic cell before lowering the anode assembly into the electrolytic cell.

According to a preferred embodiment, connecting the inert anodes of the anode assembly to the electrolyte cell comprises mechanically bolting a flexible portion of the anode assembly onto an anodic equipotential bar of the electrolyte cell.

According to a preferred embodiment, an actuator assembly is coupled to a supporting structure of the insulating transportation apparatus, the actuator assembly comprising a handling beam configured to support the anode assembly and vertically move the anode assembly, wherein releasing the anode assembly from the insulating transportation apparatus comprises releasing the anode assembly from the handling beam, the method then further comprising:

subsequent to releasing the anode assembly from the handling beam, raising the handling beam into the supporting structure of the insulating transportation apparatus; and withdrawing the insulated transportation apparatus away from the electrolytic cell.

According to a preferred embodiment, the insulating transportation apparatus comprises a door assembly for thermally isolating an opening through which the anode assembly enters into and exits from the insulating transportation apparatus, the method further comprising:

when removing the anode assembly from the anode preconditioning station and enclosing the anode assembly in the insulating transportation apparatus:

actuating the door assembly into an open position;

raising the anode assembly into an interior spacing of the insulated transportation apparatus; and closing the door assembly; and when installing the anode assembly at the electrolytic cell:

actuating the door assembly into the open position; and lowering the anode assembly from the interior spacing of the insulating transportation apparatus into the electrolytic cell.

According to another aspect, the invention is directed to an apparatus for conveying a spent anode assembly or a cell pre-heater outside of an electrolyte cell, the cell-preheater being configured to be inserted in the cell for pre-heating the cell before inserting a pre-heated anode assembly in the pre-heated cell, the apparatus comprising:

a supporting structure, defining an interior spacing;

an actuator assembly coupled with the supporting structure and configured to support the spent anode assembly or the cell pre-heater, the actuator assembly being operable to move the cell pre-heater between:

an insulated position wherein the spent anode assembly or the cell pre-heater is positioned in the interior spacing of the supporting structure; and a loading-unloading position wherein the spent anode assembly or the cell pre-heater is outside the supporting structure for loading the spent anode assembly or the cell pre-heater to the actuator assembly or unloading the spent anode assembly or the cell pre-heater from the actuator assembly; and an automated connecting system configured for electrically connecting the cell pre-heater to the electrolytic cell when the cell preheater is installed into the cell, or electrically disconnecting the spent anode assembly or the cell pre-heater from the electrolytic cell before removing them from the cell preheater.

According to a preferred embodiment, the actuator assembly may further comprise an electric insulation system for electrically isolated the cell pre-heater or the anode assembly from the actuator assembly.

According to a preferred embodiment, the actuator assembly comprises a handling horizontal beam configured to removably connect to the anode assembly and to vertically move the cell pre-heater or the anode assembly inside the interior spacing. Preferably, the actuator assembly comprises a first motor and a second motor supported by the supporting structure, each motor being respectively coupled to a moving element arranged at opposite longitudinal ends of the handling beam along which the handling beam is vertically raised and lowered. Preferably, the moving element comprises a threaded rod or a chain activated by the motor for raising or lowering the handling beam.

According to a preferred embodiment, the actuator assembly comprises a failsafe hanging device for removably engaging and supporting the cell preheater or the anode assembly. Preferably, the failsafe hanging device engages into a corresponding handling pin of the cell preheater or the anode assembly upon lowering of the actuator assembly onto the cell preheater or anode assembly.

According to a preferred embodiment, the apparatus may further comprise a thermic shelter supported by the supporting structure for protecting the supporting structure from heat irradiating from the cell-preheater or the anode assembly when the cell pre-heater or the anode assembly are removed from the cell. Preferably, the thermal shelters comprises refractory lining.

According to a preferred embodiment, the supporting structure is configured to permit ventilation of an upper zone of the supporting structure to maintain the upper zone at a lower temperature than a lower hot zone containing the cell-pre-heater or the anodes of the anode assembly.

According to a preferred embodiment, the apparatus may further comprise guiding pins which register with a structure of the electrolyte cell for facilitating operative installation of the cell pre-heater or the anode assembly thereinto.

According to a preferred embodiment, the automated connection assembly comprises a pair of pneumatic wrench and synchronized bolting system.

According to a preferred embodiment, the supporting structure comprises an attaching element which is configured to be mechanically attached to an overhead crane for transporting the apparatus.

According to another aspect, the invention is directed to a method for starting up an electrolytic cell for producing a non-ferrous metal, the electrolytic cell being configured to contain a number N of anode assemblies, with N≥1. The method comprises:

a) installing N cell preheaters in the cell in place of the N anode-assemblies;

b) preheating the cell with the N cell preheaters until to reach a given temperature in the cell;

c) pouring a melted electrolytic bath into the cell, with an amount of melted metal;

d) removing a first cell-preheater using an apparatus for conveying a spent anode assembly or a cell pre-heater outside of an electrolyte cell as defined herein;

e) inserting a pre-heated anode assembly in place of the removed cell preheater using an apparatus for conveying an anode assembly outside of an electrolyte cell as defined herein, or according to the method for delivering an anode assembly of inert anodes at a given temperature to an electrolytic cell for use in producing a non-ferrous metal as defined herein, and f) repeating (N−1) times steps d) and e) until that all the cell pre-heaters are replaced by pre-heated anode assemblies.

According to another aspect, the invention is further directed to a method for the replacement of a spent anode assembly of an electrolytic cell during the production a non-ferrous metal, the cell comprising N anode assemblies, with N≥1, plunged into a melted electrolytic bath at a given temperature. The method comprises:

a) removing the spent anode assembly from the cell using an apparatus for conveying an anode assembly or a cell pre-heater outside of an electrolyte cell as defined herein;

b) right after step a), inserting a new anode assembly, pre-heated at the given temperature, in place of the removed spent anode assembly using an apparatus for conveying an anode assembly outside of an electrolyte cell as defined herein, or according to the method for delivering an anode assembly of inert anodes at a given temperature to an electrolytic cell as defined herein;

wherein steps a) and b) are performed while the cell is producing the non-ferrous metal, and wherein steps a) and b) are repeated for each spent anode assembly of the cell to be replaced.

According to a preferred embodiment, the non-ferrous metal is aluminum, and the N anode assemblies comprises a plurality of inert anodes.

According to a preferred embodiment, the inert anodes are vertical inert anodes.

The present invention is compatible with the inert anode cell and anode assembly configuration and it solves the issue of thermal shock. Advantageously, the thermal insulation of the transfer box allows maintaining the anode temperature homogeneity and preventing the thermal shock when introducing the inert anodes into the hot electrolytic bath.

BRIEF DESCRIPTION OF THE DRAWINGS

Further features and exemplary advantages of the present invention will become apparent from the following detailed description, taken in conjunction with the appended drawings, in which:

FIG. 20 is a schematic open view of an apparatus for conveying an anode assembly or a cell pre-heater outside of an electrolyte cell, also named herein CPLB, in accordance with a preferred embodiment with (left) the handling beam in its insulated position and (right) the handling beam in its loading-unloading position;

FIG. 21 is a schematic view of the CPLB in its insulated position in accordance with a preferred embodiment, with a CP affixed to the handling beam inside the CPLB;

FIG. 22 is a schematic view of the CPLB in its insulated position in accordance with a preferred embodiment, with a SAA affixed to the handling beam inside the CPLB;

DETAILED DESCRIPTION

The Transfer Box (TB):

A carbon anode is resistant to the thermal shock occurring when the cold anode is introduced into the hot molten electrolyte and therefore no specific precaution needs to be taken neither to preheat nor to avoid a temperature difference between the new anode and the electrolytic bath.

Inert anodes are typically made of stable composites that are sensitive to thermal shocks. Because of development of new or improved smelting processes using stable composite anodes, new systems, apparatuses and methods are required for the maintenance and replacement of the anode assemblies of smelting cells.

Figure 1:
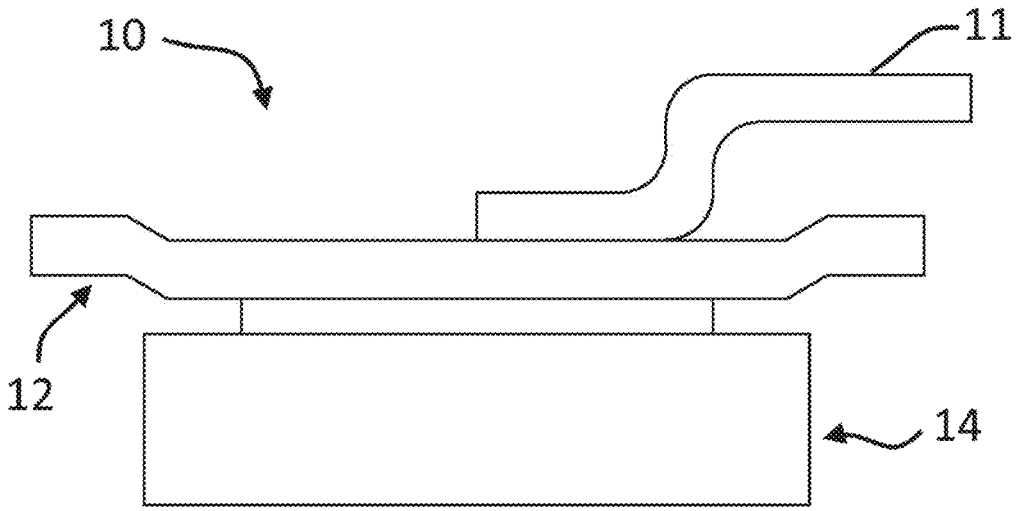
FIG. 1 is a schematic view of an anode assembly in accordance with a preferred embodiment.

In an inert anode process, the anodes are made of a composite material. As illustrated on FIGS. 1 and 2, an anode assembly 10 is comprised of a horizontal beam 12, including a flexible anode assembly 11, from which an assembly of individual anodes 14 are suspended. The anode assembly 10 is generally handled by an overhead crane 30 (as shown in FIGS. 8-11) to be typically positioned transversally to an electrolytic cell 40 (as shown on FIGS. 10-11).

Figure 2:
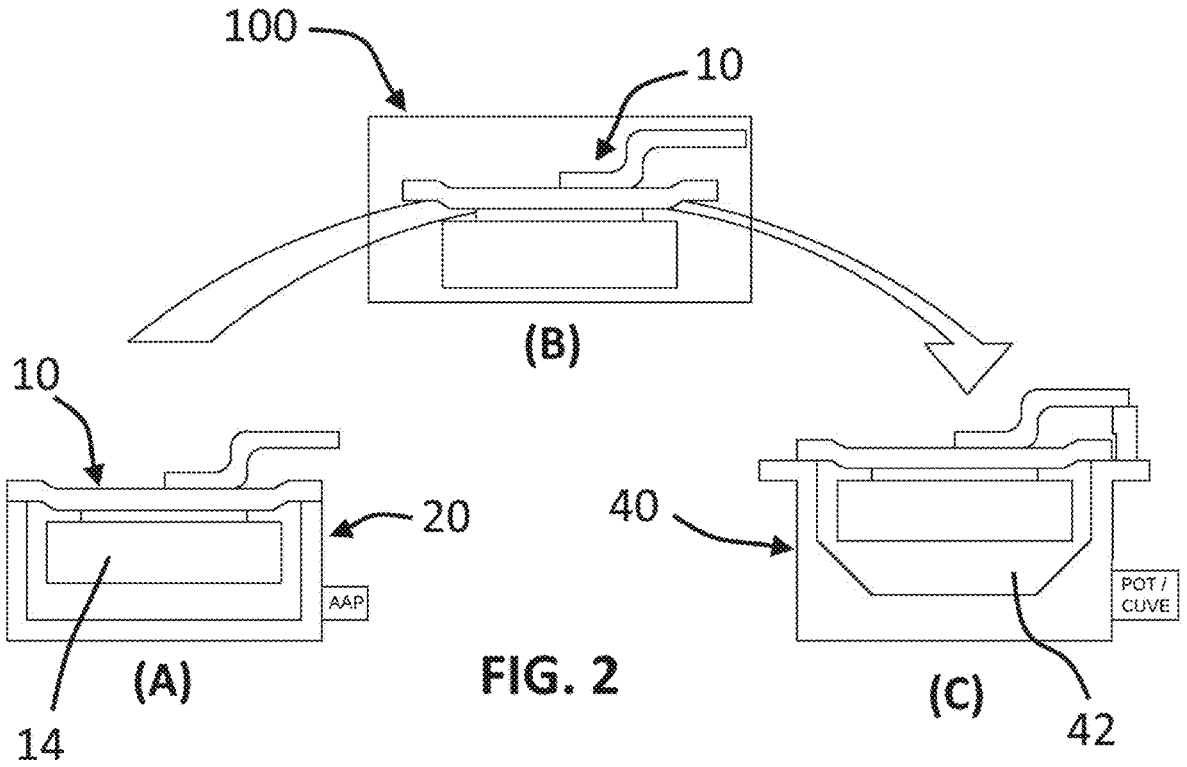
FIG. 2 illustrates the transfer (B) of the anode assembly from a preconditioning station (A) to the electrolytic cell (C), in accordance with a preferred embodiment.
Figure 3:
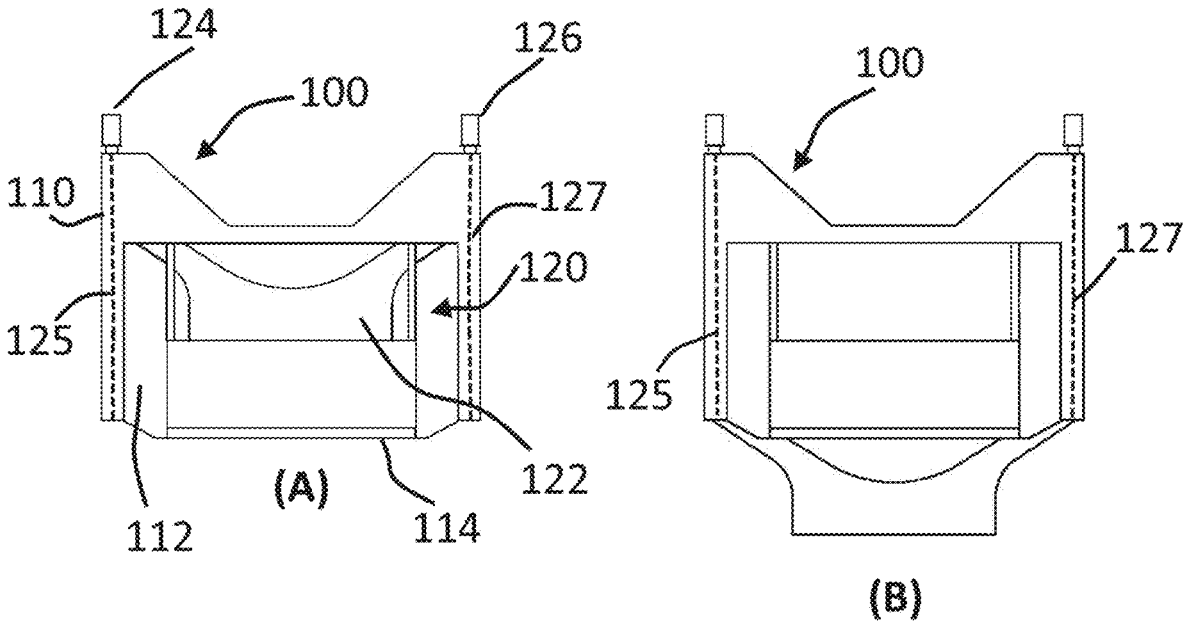
FIG. 3 is a schematic open view of a transfer box in accordance with a preferred embodiment with (A) the handling beam in its insulated position and (B) the handling beam in its loading-unloading position.

As illustrated on FIG. 2, the anode assembly (AA) 10 is first positioned into an anode preconditioning station 20 where the AA is preferably homogeneously preheated to a predetermined temperature close to the temperature of the molten electrolyte bath 42 of the electrolytic cell 40. The subsequent transport of the anode assembly 10 from the anode preconditioning station 20 to the cell 40 is preferably performed in such a way that the temperature of the inert anodes 14 and the temperature homogeneity are maintained. Preferably, temperature of the inert anodes in the anode assembly (AA) when the inert anodes are plunged in the electrolyte bath is plus or minus 25° C. from the bath temperature (predetermined tolerance range). The temperature loss within the transfer box is less than 10° C. per hour. For this purpose, it has been developed a novel apparatus 100 for conveying an anode assembly of inert anodes while maintaining the temperature of the pre-heated inert anodes before plunging the inert anodes of the anode assembly into a bath of molten electrolytes of an electrolytic cell.

The apparatus 10Q as disclosed and illustrated on FIGS. 3 to 7, also named herein after the "transfer box" or TB, first comprises a supporting structure 110 typically made of assembled metallic plate elements. The apparatus 100 defines an interior spacing 112 configured to contain the anode assembly 10.

As illustrated in FIGS. 3-8, the transfer box 100 comprises an actuator assembly 120 coupled with the supporting structure 110 and comprising an handling beam 122 configured to support the anode assembly 10. The actuator assembly 120 is operable to move the handling beam 122 relative to the supporting structure between an insulated position (FIGS. 3A-4A) for maintaining the anode assembly 10 inside the interior spacing 112 of the supporting structure; and a loading-unloading position outside the interior spacing 112 for loading and unloading of the anode assembly onto the handling beam 122 (FIGS. 3B-4B).

As better illustrated on FIG. 5(B), the supporting structure 110 comprises an open bottom 114 in communication with the interior spacing 112, and a door assembly 116 (FIG. 5B), operatively coupled to the supporting structure 110 to be moveable between an open position and a closed position to permit movement of the anode assembly 10 in and out of the transfer box 100. The door assembly 116 closes the open bottom 114 of the supporting structure 110 when the anode assembly 10 is inside the transfer box 10.

The supporting structure 110 is configured to move to an open state (See FIG. 5) when the handling beam 122 is moved from the insulated position to the loading-unloading position, and to move to a closed state (See FIG. 6) when the handling beam 122 is moved from the loading-unloading position to the insulated position.

In a traditional Hall-Heroult cell, an anode assembly typically comprises a vertical stem which is rodded in the carbon anode and is handled by an overhead crane which positions the new anodes against the cell anodic frame (centered on the longitudinal axis of the cell) and connects the anode to the frame (mechanical and electrical connection) via a connector that is activated by the crane. The lateral positioning of the anode assembly is achieved by inserting the stem between two guides bolted to the anodic frame. The vertical positioning is achieved by the movement of the anodic mast of the overhead crane from which the anode assembly is suspended. The vertical positioning of the new anode assembly is critical for the performance of the cell since the anode and cathode active faces are horizontal.

In the case of the inert anode cell, it has to be understood that a high positioning accuracy is necessary in the longitudinal vertical direction (z axis) and transversal directions (x and y axis) to ensure the correct anode/cathode distance since the anode and cathode active faces are vertical. The vertical positioning is typically achieved by the movement of the hoist of the overhead crane 30 from which the transfer box 100 is suspended. The electrical connection is typically realized by bolting the anode assembly flexible 11 onto the anodic equipotential bar that is longitudinal to the cell. As illustrated on FIGS. 3 to 6, the actuator assembly 120 allows moving the handling beam 122 (z axis) between the insulated position and the loading-unloading position while preventing horizontal tilting of the anode assembly. The actuator assembly 120 may comprise a first motor 124 and a second motor 126, each being respectively coupled to a corresponding threaded rod 125-127 arranged at opposite longitudinal ends of the handling beam 122 along which the (FIGS. 3A-4A) beam is raised and lowered. The two lifting motors 124-126, which are preferably coupled so as to allow lowering the anode assembly in perfect horizontal way through and to ensure that the horizontal beam 12 of the anode assembly 10 may engage freely its positioning pins.

Figure 6:
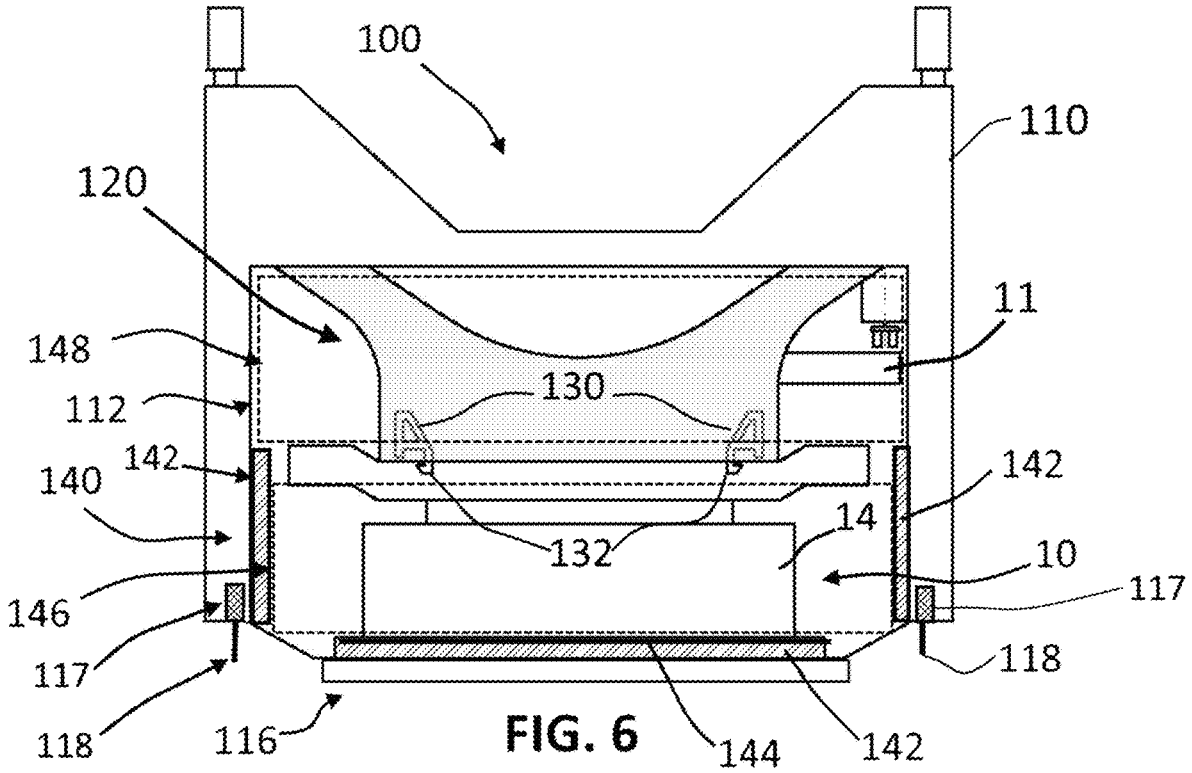
FIG. 6 is a schematic view of the transfer box in accordance with a preferred embodiment with the handling beam in its insulated position and showing the different mechanisms for moving up and down the handling beam, for clamping/releasing the anode assembly and for tightening the electrical connection.

As illustrated on FIG. 6, the handling beam 122 may comprise at least one failsafe hanging device 130 for affixing to and supporting the anode assembly. The failsafe hanging device 130 engages into a corresponding handling pin 132 of the anode assembly upon lowering of the handling beam onto the anode assembly. The failsafe device is preferably a semi-automatic failsafe devices that engage into the anode assembly handling pins upon lowering onto the anode assembly, lowering as such the risk of dropping an anode assembly through. The failsafe devices 130 can only disengage when the anode assembly is resting onto the superstructure 44 of the electrolytic cell 40.

Figure 4:
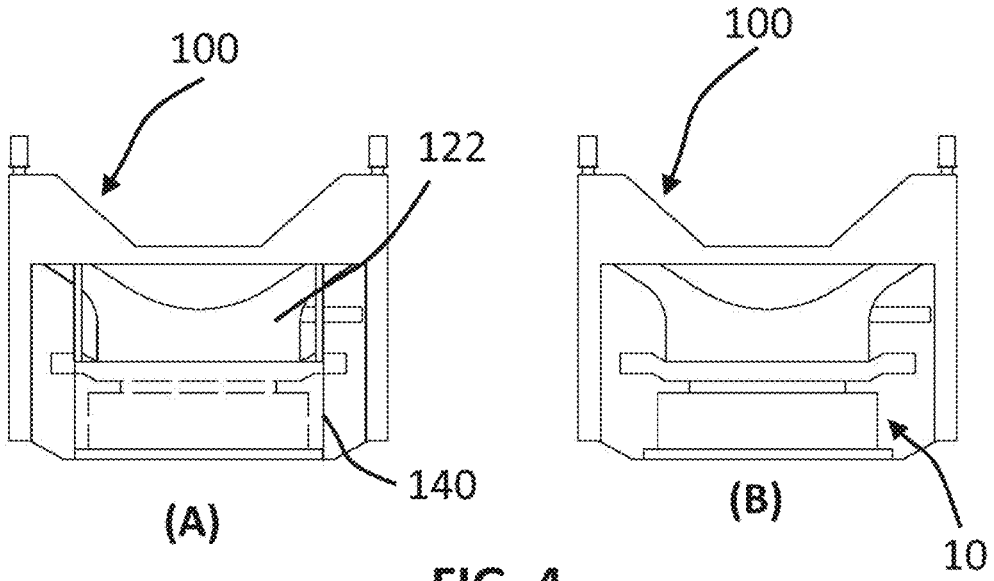
FIG. 4 is a schematic view of the transfer box in its insulated position in accordance with a preferred embodiment showing (A) the anode assembly behind the thermal shelter assembly, and (B) the anode assembly affixed to the handling beam inside the transfer box.
Figure 5:
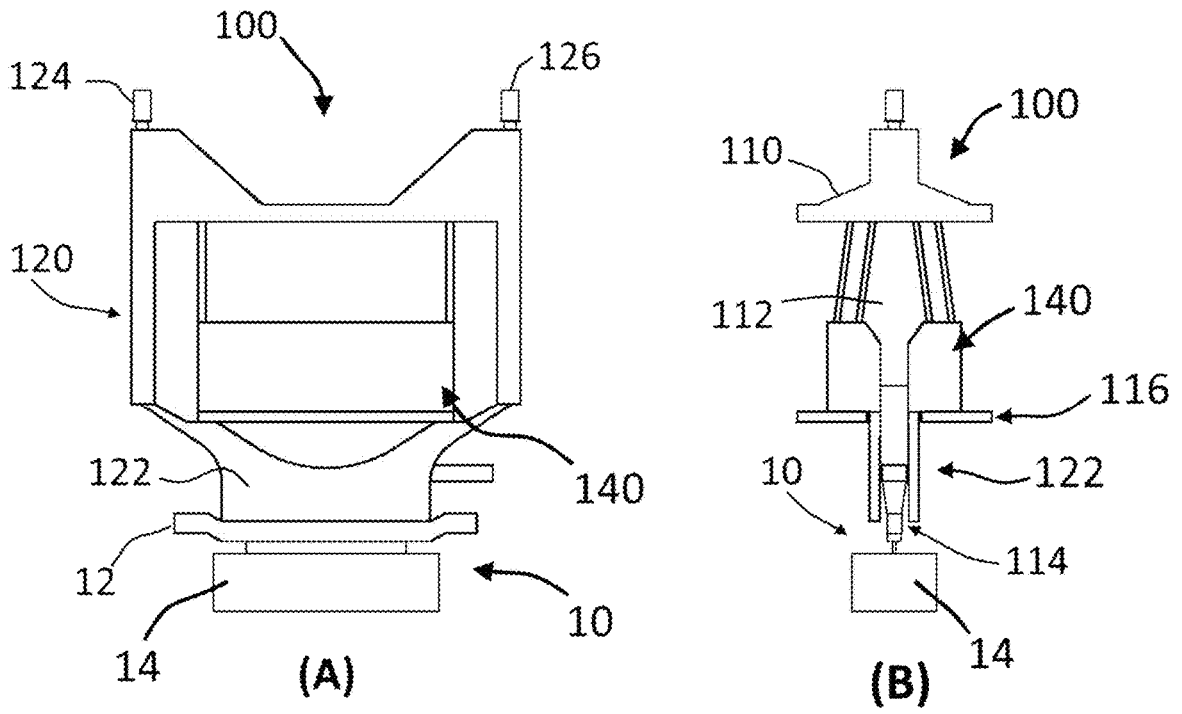
FIG. 5 is a schematic view of the transfer box in accordance with a preferred embodiment showing: (A) the transfer box in its loading-unloading position with the anode assembly below the thermal shelter assembly, and (B) a lateral view of the same with the door assembly in its open position.

As illustrated on FIGS. 4 to 6, the apparatus 100 may also comprise a thermal shelter assembly 140 extending from an interior surface of the supporting structure 110 for facing the inert anodes of the anode assembly, and operative to insulate the anode assembly 10 on a plurality of sides when the anode assembly is in the interior spacing 112. The thermal shelter assembly 140 may comprise several thermal panels 142 arranged vertically and horizontally within the supporting structure for interfacing with corresponding vertical surfaces of the inert anodes 14 when the anode assembly 10 is in the interior spacing 112. For instance, the thermal shelter assembly may comprise refractory lining 144. Also, thermal shelter assembly may be equipped with an heater system, such as electric heaters, for heating or maintaining the temperature of the pre-heated inert anodes when the anode assembly is in the interior spacing.

FIG. 6 shows the inert anodes 14 of the anode assembly 10 enclosed by the thermal panels 142 of the thermal shelter 140 and the bottom doors 116 also equipped with thermal lining 144. The supporting structure 110 then defines a low hot zone 146 comprising the inert anodes 14 and in which the temperature of the inert anodes 14 is maintained during the transportation of the apparatus 100 toward the cell (see FIG. 2 or 9). The insulating structure 100 is also configured to permit ventilation of an upper cool zone 148 located inside the interior spacing 112 above the anode assembly 10 and the lower hot zone 144, to maintain the upper cool zone 148 at a temperature lower than the hot zone. For instance, when the temperature inside the lower hot zone is about 900° C., the temperature in the upper cool zone can be around 150° C.

Figure 6B:
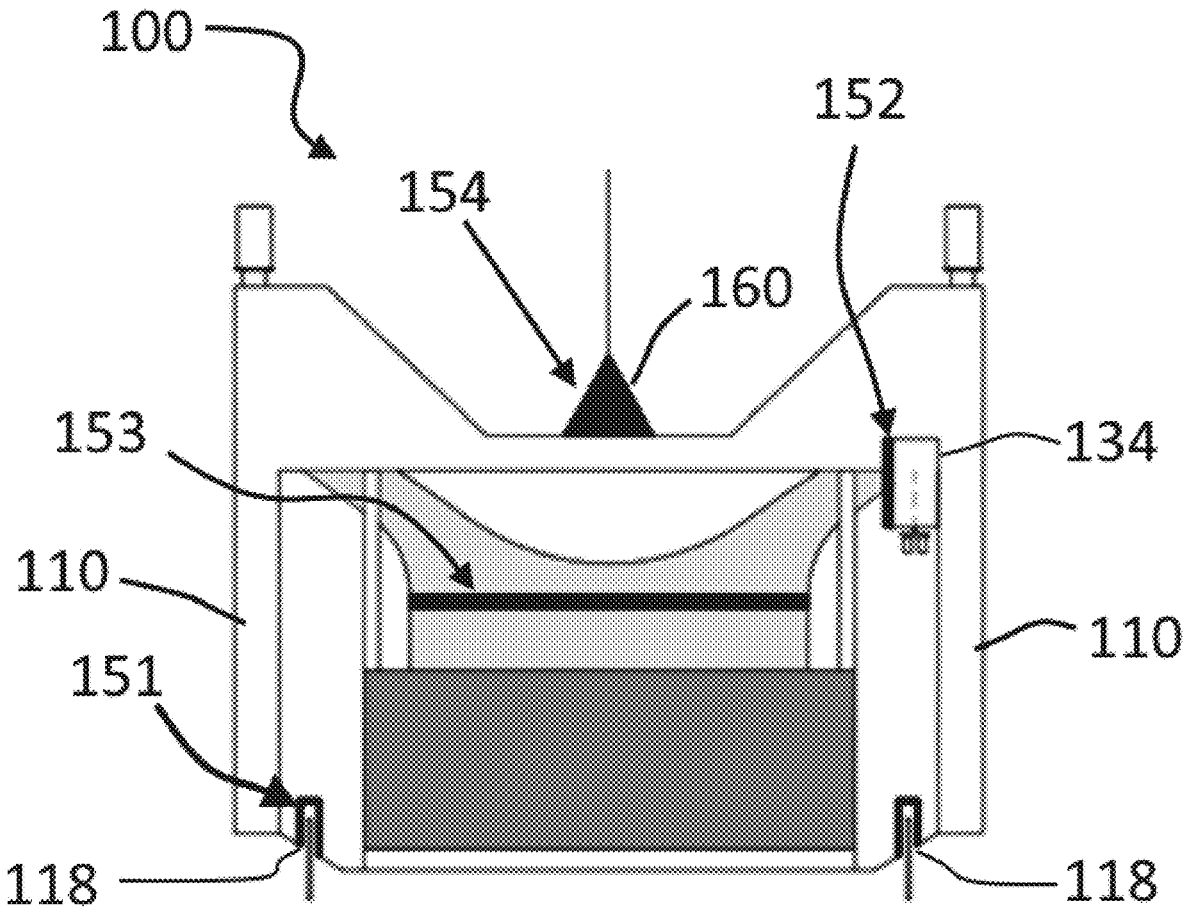
FIG. 6B illustrates different positions of electrical isolating elements of the transfer box in accordance with preferred embodiments.

FIG. 6B illustrates the different positions of electrical isolating elements 151-154 of the transfer box 100. In particular, a first electrical isolating element 151 can be positioned between the supporting structure 110 and the guiding pins 118, a second electrical isolating element 152 on a top portion of the actuator assembly 120, a third electrical isolating element 153 between the automatic connection assembly 134 and the supporting structure 110, and also eventually a fourth electrical isolating element 154 for isolating the transfer box 100 from the crane, for instance in collaboration with an handling hook 160 at the top section of the box. This fourth element 154 can be also part of the main supporting bridge or crane 30.

Figure 7:
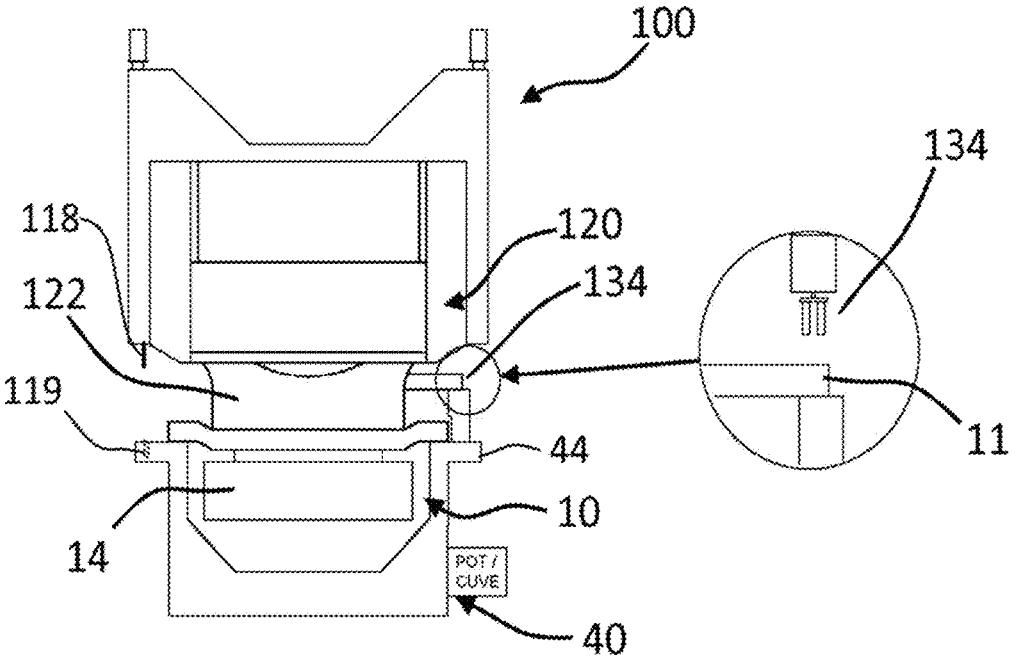
FIG. 7 illustrates details of the automatic connections of the transfer box or apparatus with the electrolytic cell in accordance with a preferred embodiment.
Figure 8:
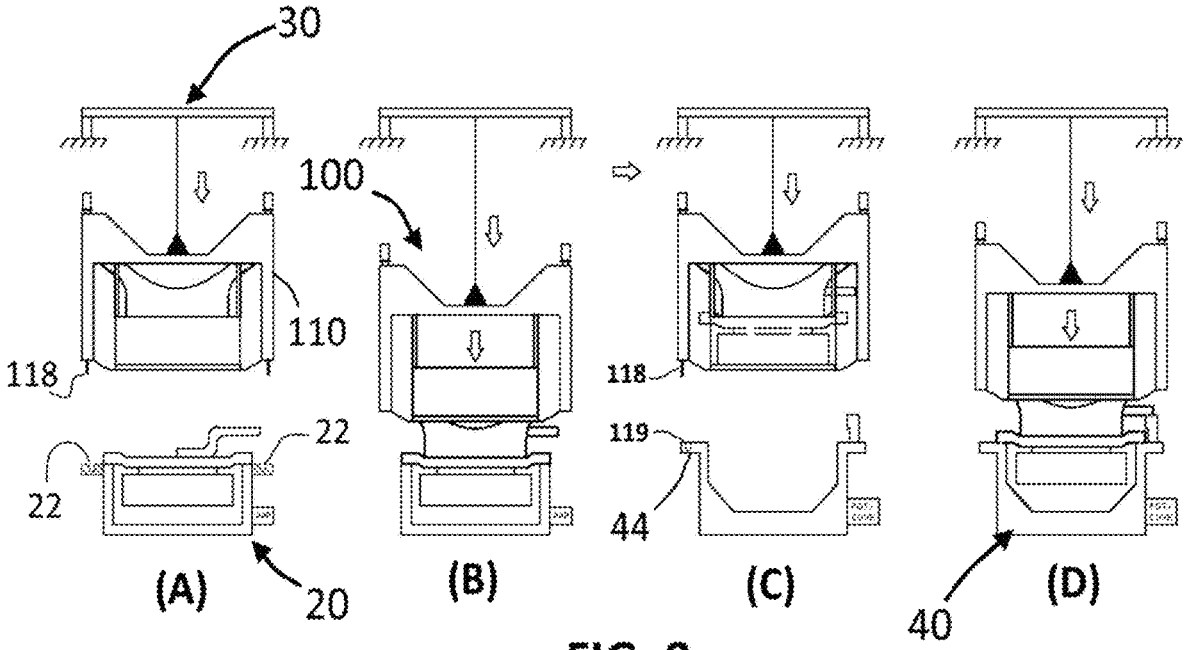
FIG. 8 illustrates the different steps for loading the pre-heated anode assembly into the transfer box from the preconditioning station in views (A) to (C), and for unloading the anode assembly from the transfer box into the electrolytic cell, view (D), in accordance with preferred embodiments.

As shown on FIGS. 6-8, in order to guarantee the vertical (z axis) and transversal (x, y axis) alignment of the anode assembly with the cell 40, the apparatus 100 may further comprise guiding pins 118 which register onto matching orifices 119 of the superstructure of the electrolyte cell 40 allowing as such for an accurate positioning onto the cell. The guiding pins 118 can be movable using moving systems 117, to ease the insertion of the pins into its respective matching orifice 119. The pin 118 are also configured to register or be inserted into matching orifices 22 of the preconditioner 20, as shown on FIG. 8 (A).

As shown on FIG. 7, the actuator assembly 120 may further comprise an automatic connection assembly 134 to electrically connect the anode assembly 10 to the electrolyte cell 40. Preferably, the electrical connection is a high intensity (HI) connection. The automatic connection assembly 134 may comprise a pneumatic wrench, a synchronised bolting system and high amperage connector(s).

As shown on FIG. 8, the apparatus 100, and more particularly the supporting structure 110, is configured to be mechanically attached to an overhead crane 30 for transportation.

According to another aspect, the present invention is directed to a method for delivering an anode assembly of inert anodes at a given temperature to an electrolytic cell for use in producing a non-ferrous metal, such as but not limited to aluminum. Reference can be made to the drawings of FIGS. 2 and 8 to 11 and the flowcharts of FIGS. 12 to 16.

Figure 12:
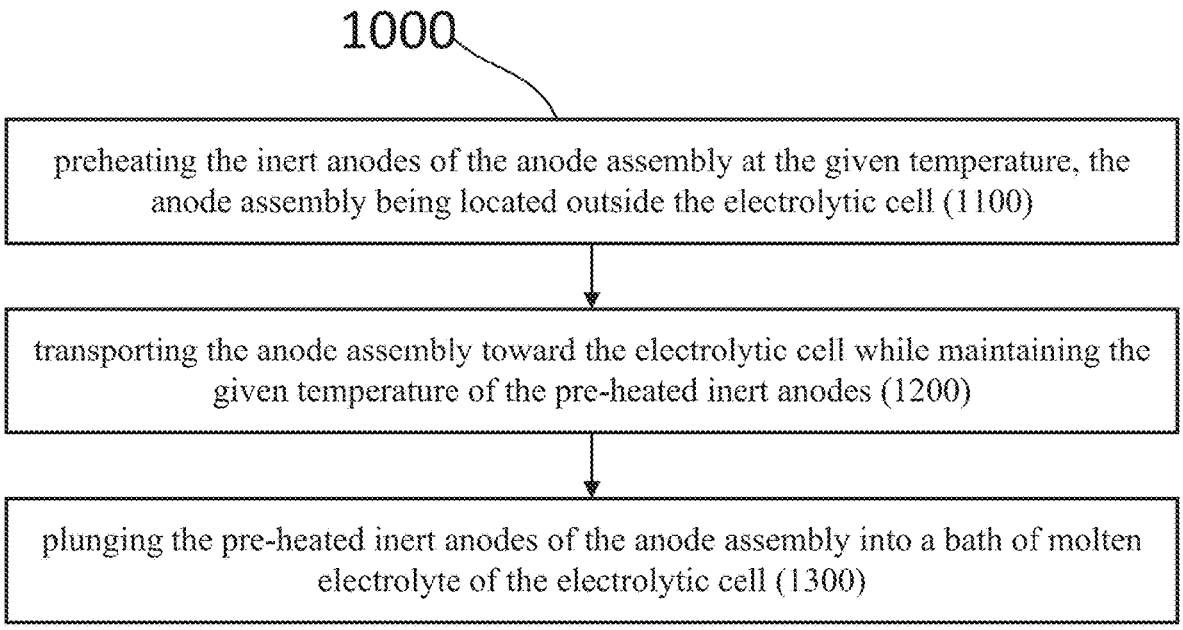
FIG. 12 is a flowchart for illustrating a method an anode assembly of inert anodes at a given temperature to an electrolytic cell for use in producing a non-ferrous metal according to preferred embodiments.

As illustrated FIGS. 2 and 12, the method 1000 typically comprises the steps of:

- preheating the inert anodes 14 of the anode assembly 10 at the given temperature 1100, the anode assembly 10 being located outside the electrolytic cell 40;
- transporting the anode assembly 10 toward the electrolytic cell while maintaining the given temperature of the pre-heated inert anodes 1200; and
- plunging the pre-heated inert anodes of the anode assembly into a bath of molten electrolyte of the electrolytic cell 1300.

Figure 13:
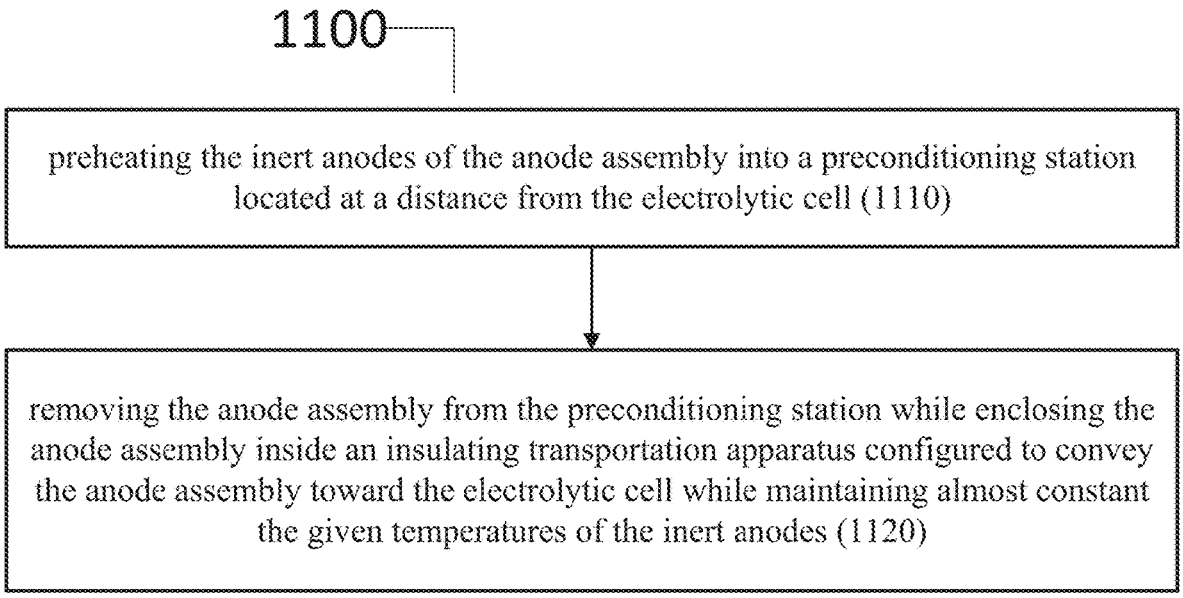
FIG. 13 is a flowchart for illustrating the method according to a first preferred embodiment.

As illustrated on FIG. 8 or 13, the step a) of preheating the inert anodes of the anode assembly 1100 is performed inside a preconditioner 20, also named preconditioning station, located at a distance from the electrolytic cell (FIG. 8A), 1110. The preconditioner is configured to receive the anode assembly (FIG. 8A) and to heat the inert anodes at a given or predetermined temperature that should be close to the temperature of the molten electrolyte bath 42 of the electrolytic cell 40 into which the inert anodes are going to be plunged. In order to maintain the temperature of the inert anodes during the transportation toward the cell 40, the method then preferably further comprises before step b) 1120, the step of removing the anode assembly from the anode assembly preconditioner 20 while enclosing the anode assembly inside the insulating transportation apparatus 100 configured to convey the anode assembly toward the electrolytic cell while maintaining constant, or almost constant, the given temperatures of the inert anodes.

Figure 14:
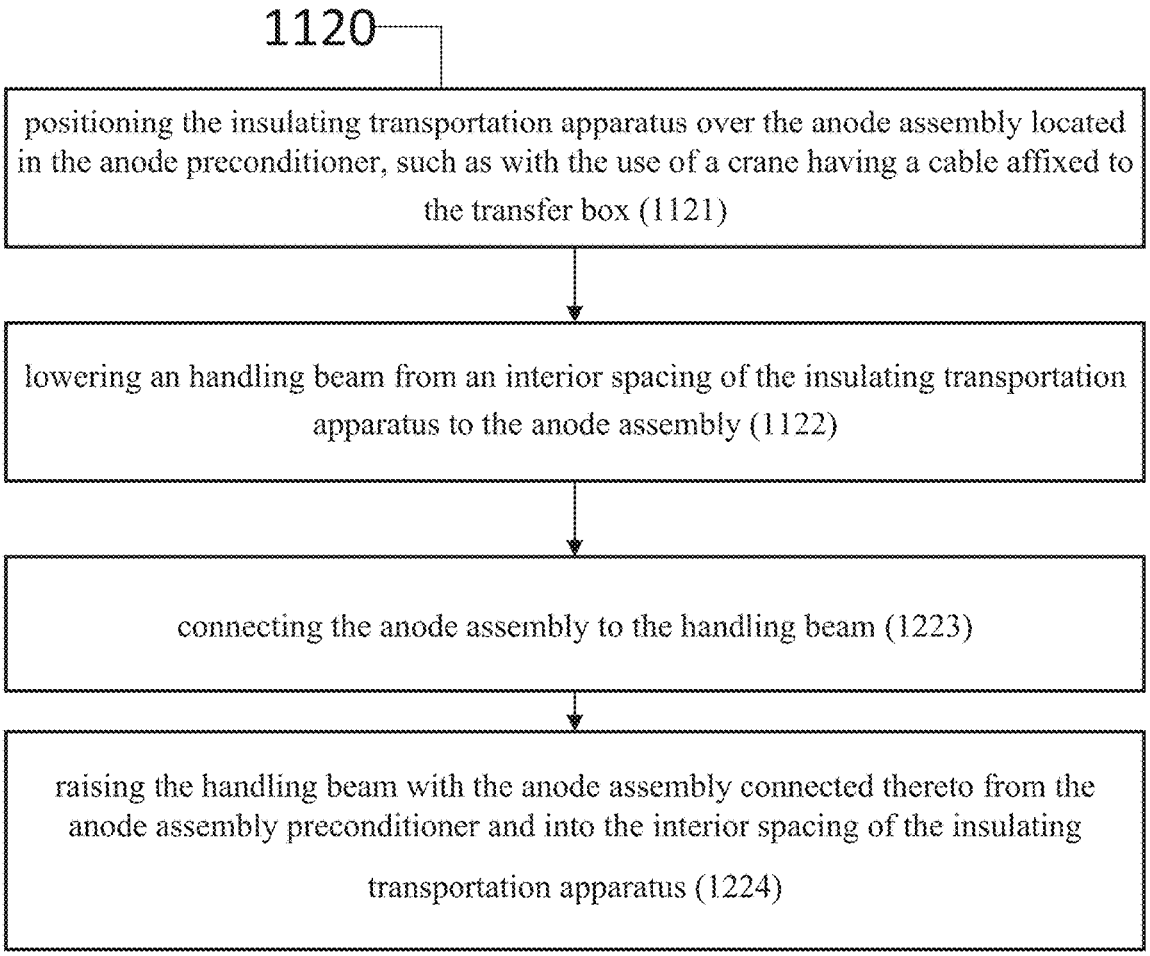
FIG. 14 is a flowchart for illustrating the method according to a second preferred embodiments.

According to a preferred embodiment as illustrated on FIGS. 8 and 14, the step of removing the anode assembly from the anode assembly preconditioner and enclosing the anode assembly in the insulating transportation apparatus 1120 may comprise the steps of:

- positioning the insulating transportation apparatus 100 over the anode assembly 10 located in the anode preconditioner 20 (see FIG. 8A), such as with the use of a crane 30 having a cable affixed to the transfer box 1121;
- lowering an handling beam 122 from an interior spacing 112 of the insulating transportation apparatus to the anode assembly (see FIG. 8B) 1122;
- connecting the anode assembly to the handling beam 1223; and
- raising the handling beam with the anode assembly connected thereto from the anode assembly preconditioner 20 and into the interior spacing of the insulating transportation apparatus (FIG. 8C) 1224.

Figure 9:
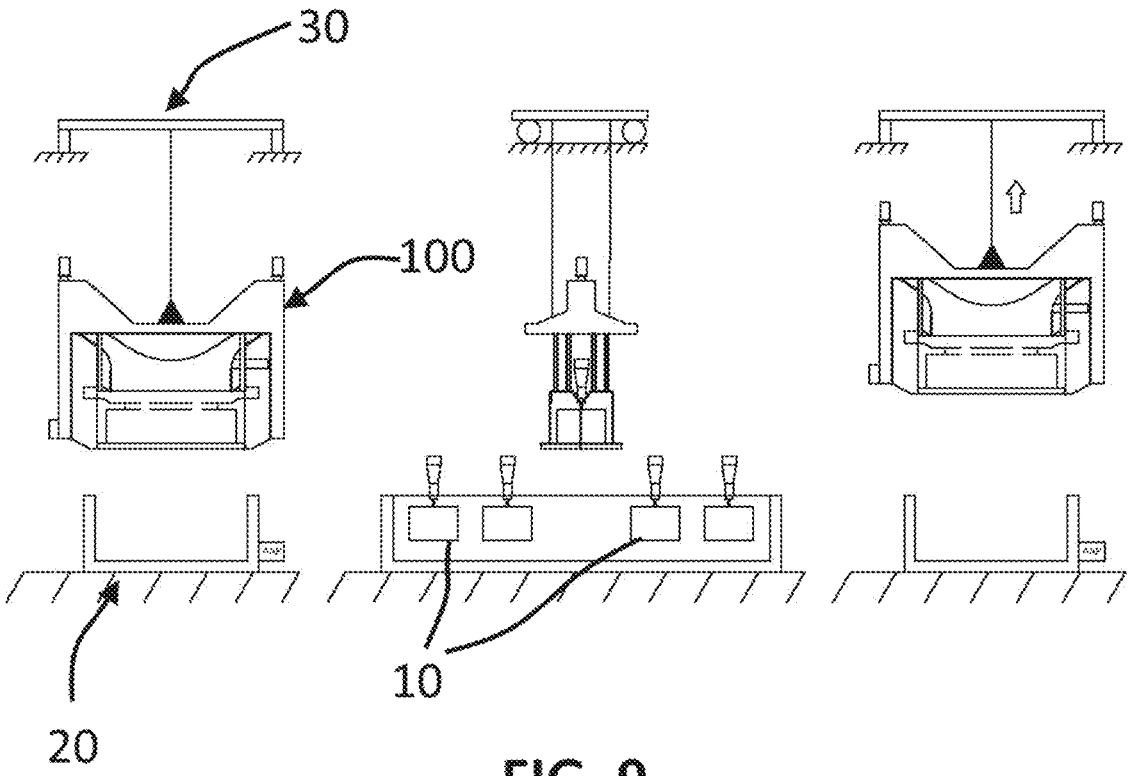
FIG. 9 illustrates different view of the transfer box and the preconditioning station: when an anode assembly is loaded into the transfer box front view (A) and side view (B), and the crane raising up the transfer box, front view (C), in accordance with preferred embodiments.
Figure 15:
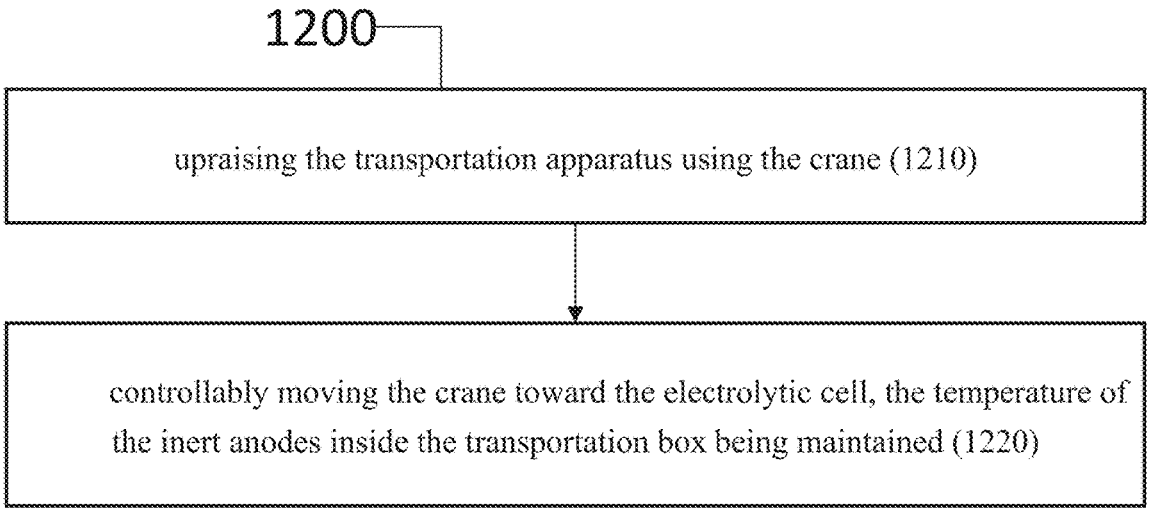
FIG. 15 are flowchart for illustrating the method according to a third preferred embodiments.

According to a preferred embodiment as illustrated on FIGS. 9 and 15, the step of transporting the anode assembly 10 toward the electrolytic cell 40 while maintaining the given temperature of the pre-heated inert anodes 1200, may comprise the steps of:

- upraising the transportation apparatus using the crane 1210, and controllably moving the crane 30 toward the electrolytic cell (FIGS. 9 and 10), while the temperature of the inert anodes 14 inside the transportation box being maintained 1220, for instance thanks to the thermal shelter or other devices described herein for maintaining the temperature constant.

Figure 10:
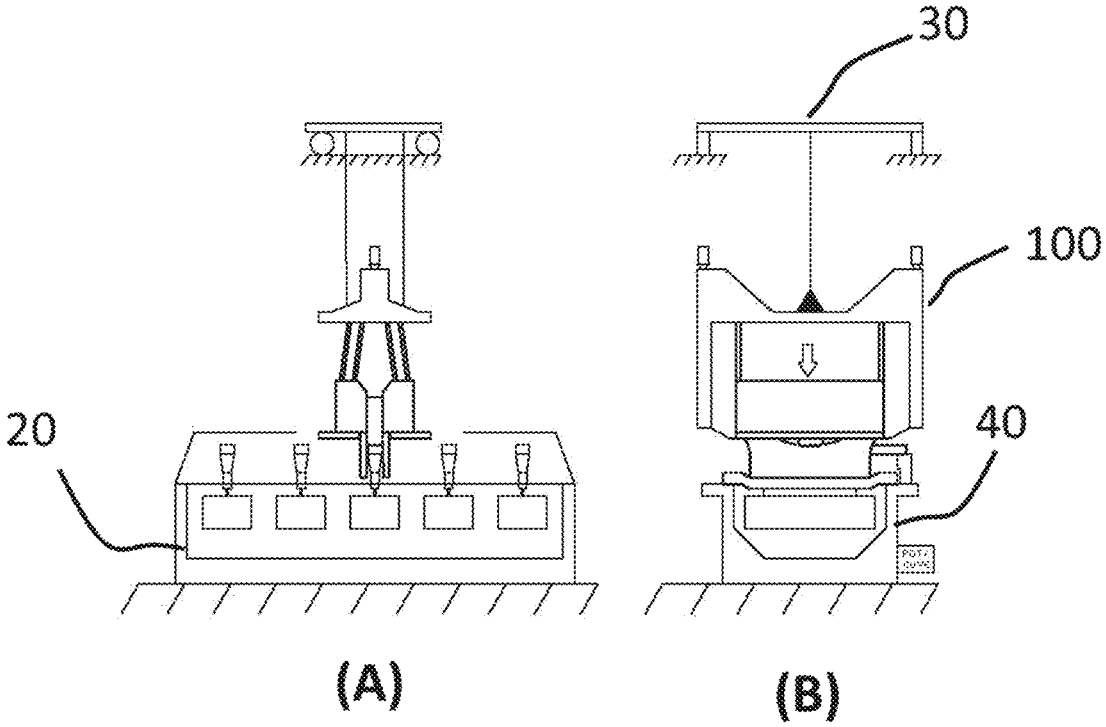
FIG. 10 illustrates the unloading of the anode assembly from the transfer box into the electrolytic cell: side view (A) and front view (B) in accordance with preferred embodiments.
Figure 16:
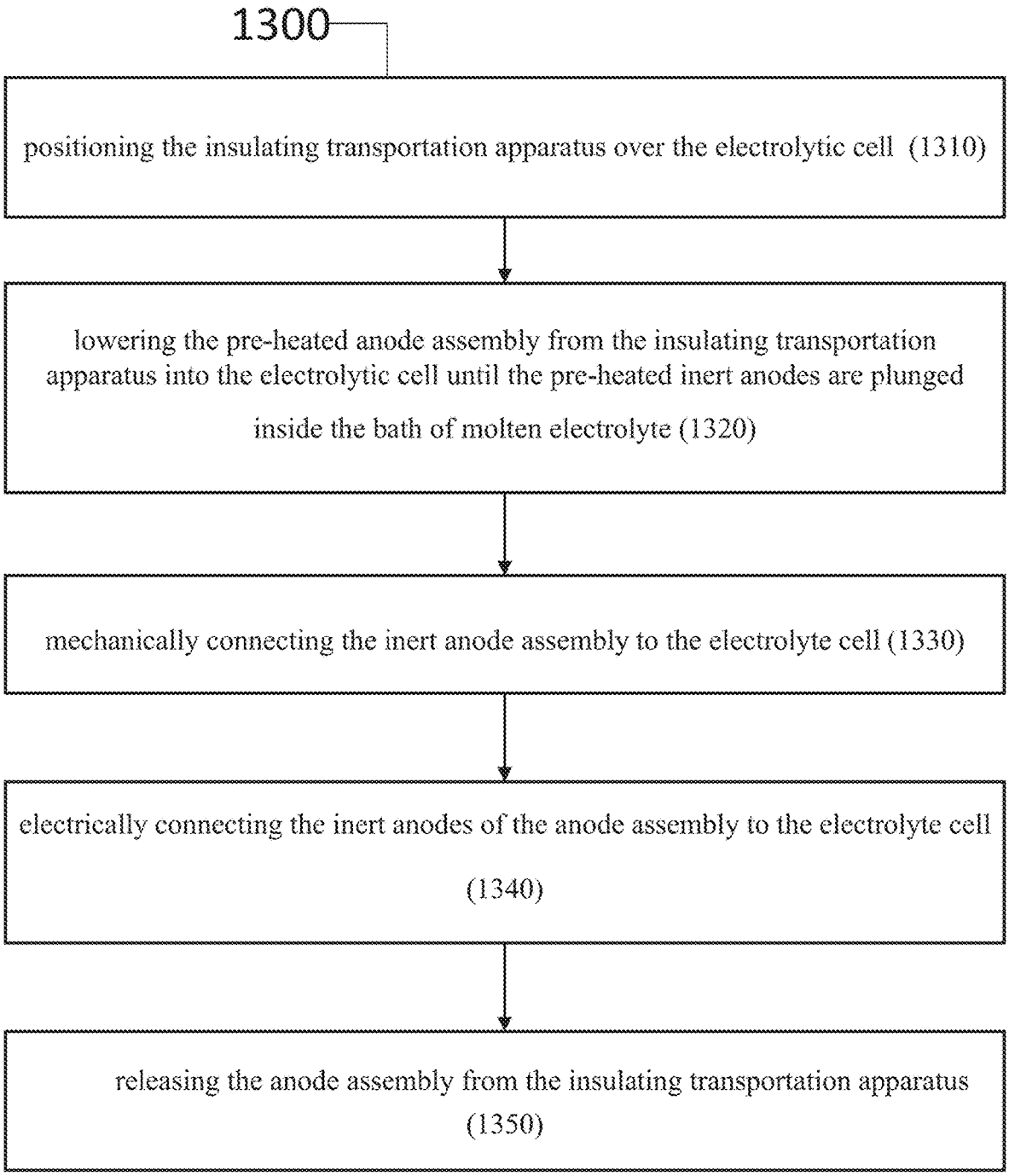
FIG. 16 is a flowchart for illustrating the method according to a fourth preferred embodiments.

According to a preferred embodiment as illustrated on FIGS. 8, 10 and 16, the step of plunging the pre-heated inert anodes of the anode assembly into a bath of molten electrolyte of the electrolytic cell 1300 comprises:

positioning the insulating transportation apparatus over the electrolytic cell (see FIG. 8C or 10A) 1310;

lowering the anode assembly 10 from the insulating transportation apparatus into the electrolytic cell until the pre-heated inert anodes 14 are plunged inside the bath of molten electrolyte (FIG. 8D or 10B) 1320;

mechanically connecting the anode assembly 10 to the electrolyte cell 1330;

electrically connecting the inert anodes 14 of the anode assembly 10 to the electrolyte cell 1340; and releasing the anode assembly from the insulating transportation apparatus 1350.

According to a preferred embodiment, the step of lowering the anode assembly into the production pot or bath of the cell may comprise the step of registering guiding pins of the insulating transportation apparatus to respective receiving apertures of the electrolytic cell while lowering the anode assembly into the electrolytic cell with the guiding pins registered.

According to a preferred embodiment, the step of electrically connecting the inert anodes of the anode assembly to the electrolyte cell may comprise pneumatically bolting a flexible portion of the anode assembly onto an anodic equipotential bar of the electrolyte cell.

As described herein, the insulating transportation apparatus comprises a supporting structure and an actuator assembly coupled thereto, the actuator assembly comprising an handling beam configured to support the anode assembly and vertically move the anode assembly. Therefore, the step of releasing the anode assembly from the insulating transportation apparatus may comprise the step of releasing the anode assembly from the handling beam. The method may then further comprise subsequent to releasing the anode assembly from the handling beam, raising the handling beam into the supporting structure of the insulating transportation apparatus; and withdrawing the insulated transportation apparatus away from the electrolytic.

As described herein, the insulating transportation apparatus 100 comprises a door assembly 116 for sealing an opening 114 through which the anode assembly enters into and exits from the insulating transportation apparatus. Then, the method may further comprise:

when removing the anode assembly from the anode preconditioner and enclosing the anode assembly in the insulating transportation apparatus:

(i) moving the door assembly into an open position;

(ii) raising the anode assembly into an interior spacing of the insulated transportation apparatus; and (iii) closing the door assembly; and when installing the anode assembly at the electrolytic cell:

(i) moving the door assembly into the open position; and (ii) lowering the anode assembly from the interior spacing of the insulating transportation apparatus into the electrolytic.

Figure 11:
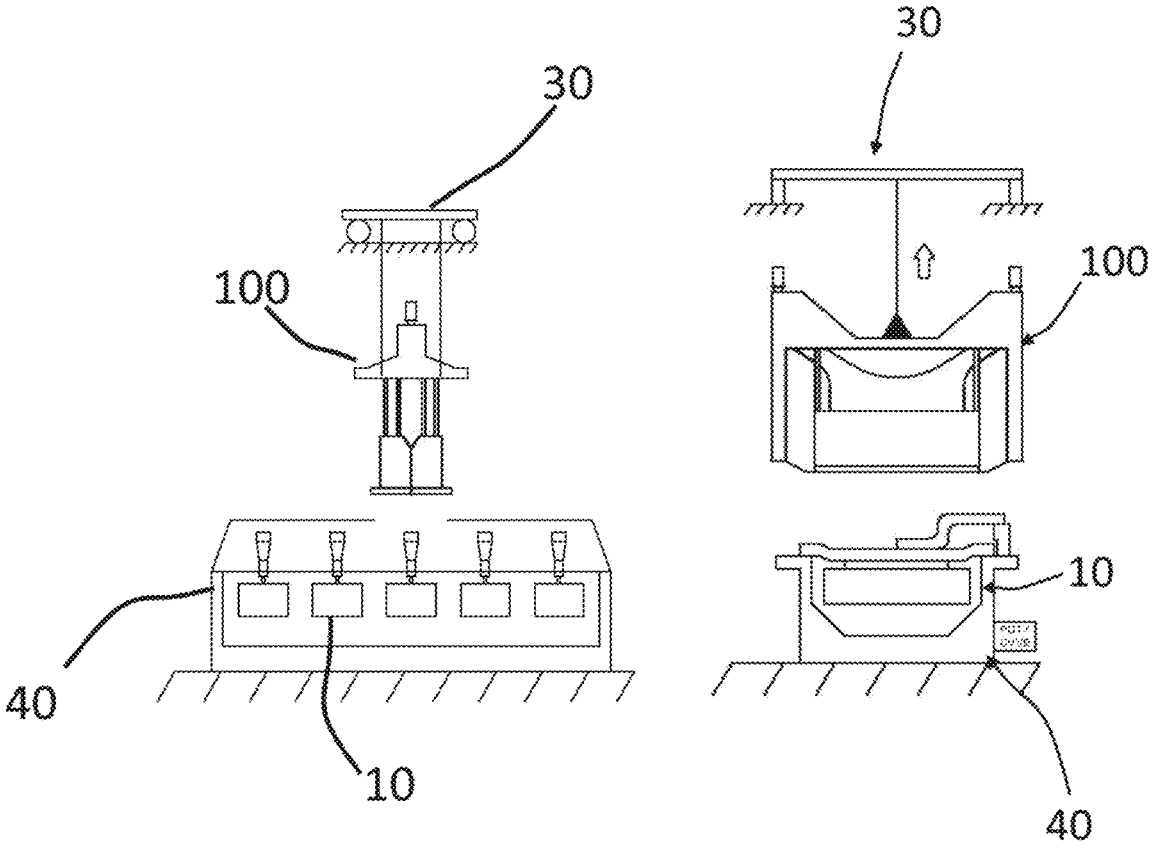
FIG. 11 illustrates the removal of the transfer box once the anode assembly has been loaded into the electrolytic cell: side view (A) and front view (B), in accordance with preferred embodiments.

As illustrated on FIG. 11, once the anode assembly has been unloaded to the electrolytic cell 40, the box is raised by the crane 30 to return to the preconditioning station 20 in order to load a subsequent anode assembly.

The Cell Preheater Lifting Beam, or CPLB:

As aforesaid, electrolytic cells working with inert anodes need to be pre-heated, typically using a cell pre-heater, also named CP herein. The cell pre-heater has to be inserted into the tank of the cell for pre-heating the cell, typically containing dry electrolyte to be melt, and then removed from the cell before introducing pre-heated anodes in the cell. Furthermore, even though inert anodes do not have to be removed from a cell as frequently as consumable carbon anodes, a spent anode assembly (SAA) has to be removed once and a while for maintenance and replaced right away by a new pre-heated anode assembly (AA). The Applicant has therefore developed an apparatus, named "cell preheater lifting beam", or CPLB, similar with the transfer box as disclosed herein, for safely and accurately inserting a CP in a cell, removing the same CP from the cell once the cell is preheated. The CPLB can also be used for removing a spent anode assembly (SAA) from the cell before inserting a new pre-heated anode assembly into the cell using the transfer box (TB).

Figure 17:
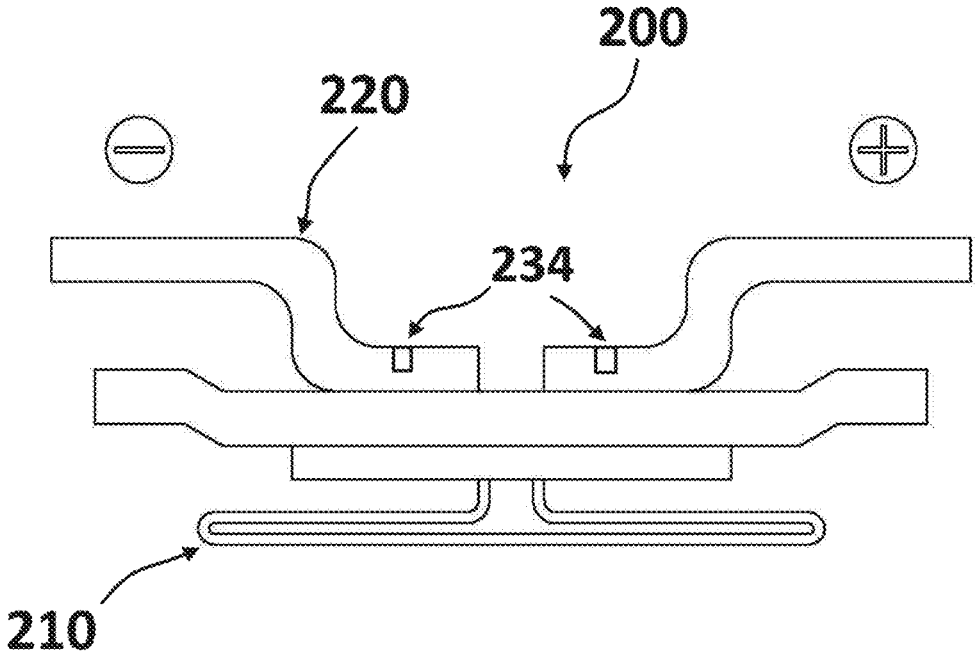
FIG. 17 is a schematic view of a cell preheater (CP) in accordance with a preferred embodiment.

FIG. 17 is a schematic view of a cell preheater (CP) that has also been developed by the Applicant. The cell preheater 200 may comprise at least one electrical heater 210 comprising at least one resistance electrically powered via a bus bar 220. The CP 200 is configured to be installed in the electrolytic cell in place of the corresponding anode assembly for pre-heating the cell before installing the corresponding anode assembly into the cell. As described herein later, the bus bar 220 may comprises connecting elements 234 for connecting the CPLB to the CP and transporting the CP. This example of a CP is disclosed in Applicant's provisional application U.S. Ser. No. 63/018,680 filed on May 1, 2020 at the U.S. patent office, the content of which is incorporated herein by reference. Any other kinds of cell pre-heater can be used without departing from the scope of the present invention.

Figure 18:
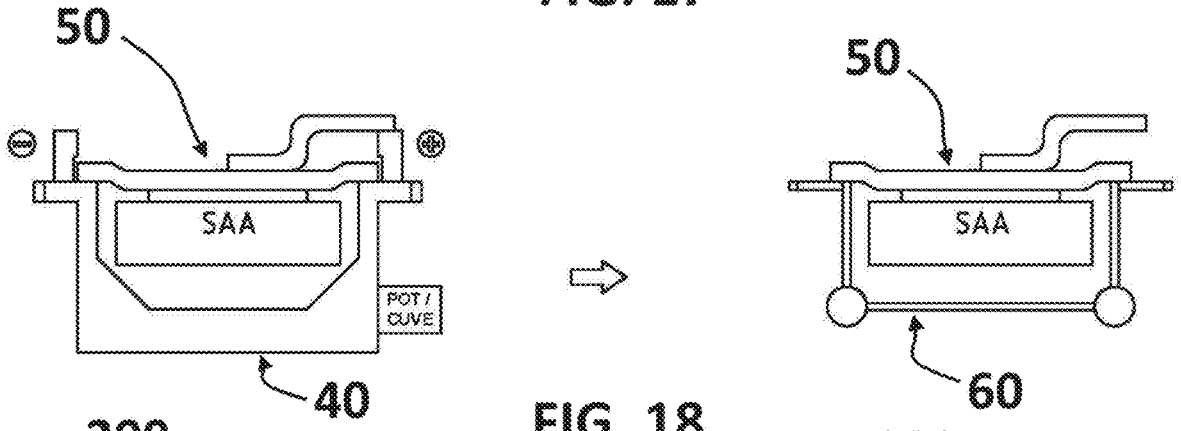
FIG. 18 illustrates the transfer of a spent anode assembly (SAA) from the electrolytic cell (left) to a chariot for maintenance (right), in accordance with a preferred embodiment.

FIG. 18 illustrates the transfer of a spent anode assembly (SAA) 50 from the electrolytic cell 40 (left), in which the SAA is electrically connected to the equipotential (symbols (+) and (−)) of the cell to a chariot for conveyance outside the building for maintenance 60 (right).

Figure 19:
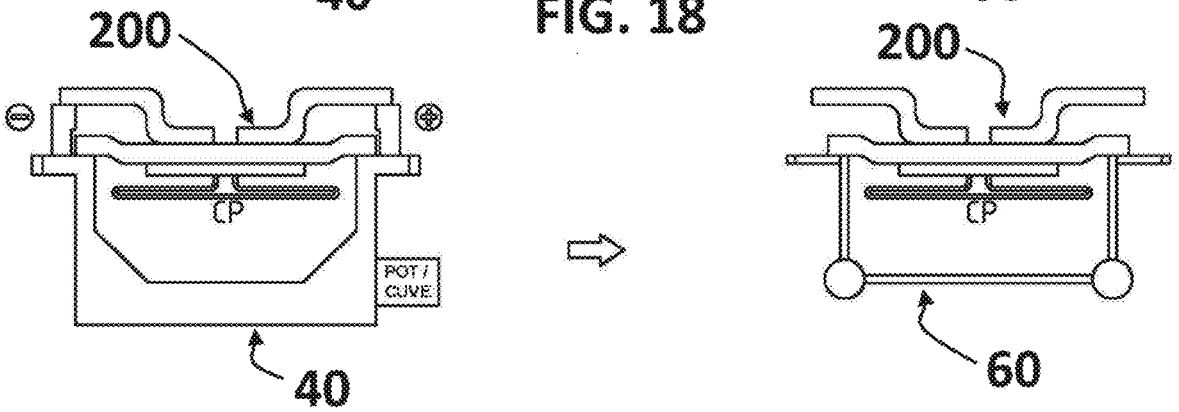
FIG. 19 illustrates the transfer of a cell preheater (CP) from the electrolytic cell (left) to a chariot (right), in accordance with a preferred embodiment.

FIG. 19 illustrates the transfer of a cell preheater 200 (CP) from the electrolytic cell 40 (left) to the chariot 60 (right). The start-up of the cell requires removing the CP once the cell has been heated at the required temperature for the electrolysis reaction. The CP is connected upstream the equipotential of the cell (symbol (+)) and downstream the equipotential of the cell (symbol (−)). Once removed, the CP is placed on a chariot for conveyance outside the building. The CP is immediately replaced in the cell by a new anode assembly, for instance by using the transfer box 100 as described herein.

FIG. 20 is a schematic open view of the CPLB 300 in accordance with a preferred embodiment. The apparatus 300 comprises a supporting structure 310, defining an interior spacing 312; an actuator assembly 320 coupled with the supporting structure 310 and configured to support the anode assembly or the cell pre-heater. As shown in FIG. 20, the actuator assembly 320 is operable to move vertically between an insulated position (left drawing) wherein the cell pre-heater or the spent anode assembly will be positioned in the interior spacing 312 of the supporting structure 310 as illustrated in FIGS. 21 and 22 respectively; and a loading-unloading position (FIG. 20, right drawing) wherein the anode assembly or the cell pre-heater will be outside the supporting structure for loading the anode assembly or the cell pre-heater to the actuator assembly or unloading the anode assembly or the cell pre-heater from the actuator assembly.

According to a preferred embodiment, the actuator assembly 320 of the CPLB comprises a handling horizontal beam 322 configured to removably connect to the anode assembly and to vertically move the cell pre-heater or the anode assembly inside the interior spacing. The actuator assembly 320 may comprise a first motor 324 and a second motor 326 supported by the supporting structure 310, each motor being respectively coupled to a moving element 325 arranged at opposite longitudinal ends of the handling beam 322 along which the handling beam is vertically raised and lowered. Preferably, the moving element 325 may comprise, for each motor 324, 326 a threaded rod or a chain activated by the motor for raising or lowering the handling beam 322.

Figure 25:
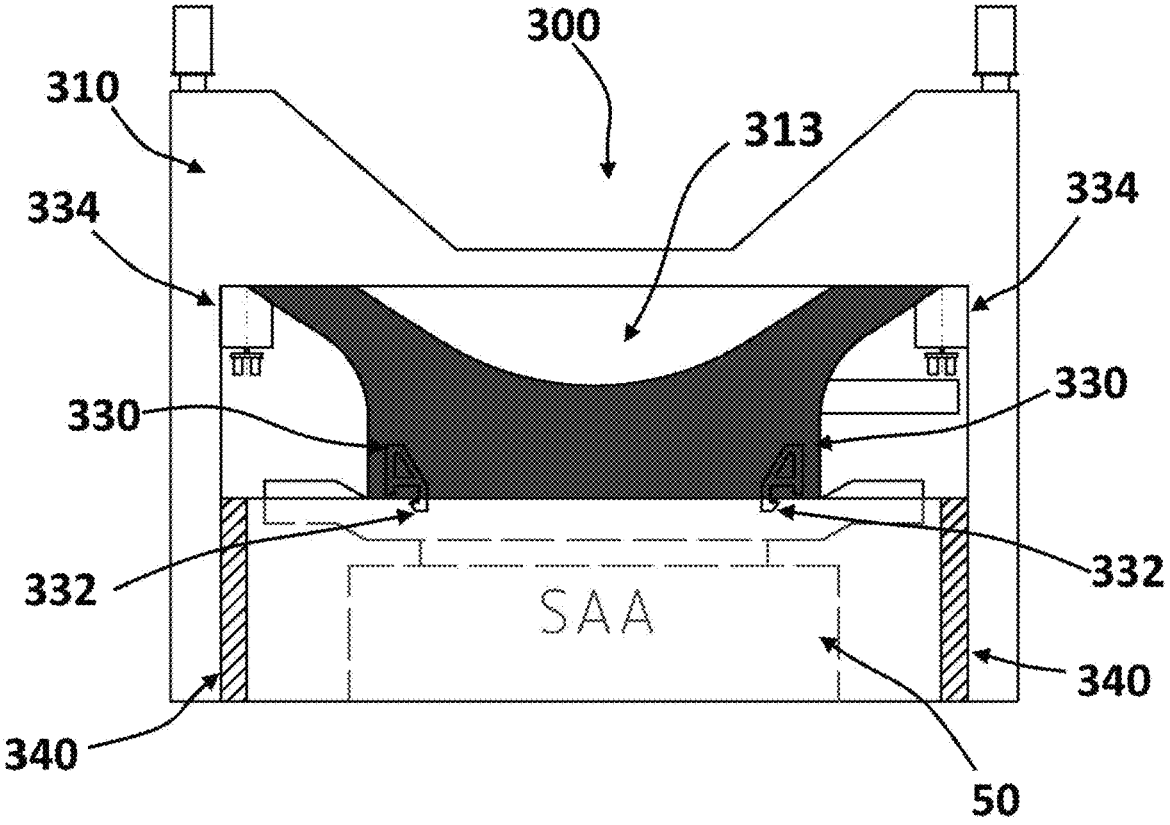
FIG. 25 is a schematic open view of the CPLB in accordance with a preferred embodiment with the handling beam in its insulated position supporting a SAA.
Figure 26:
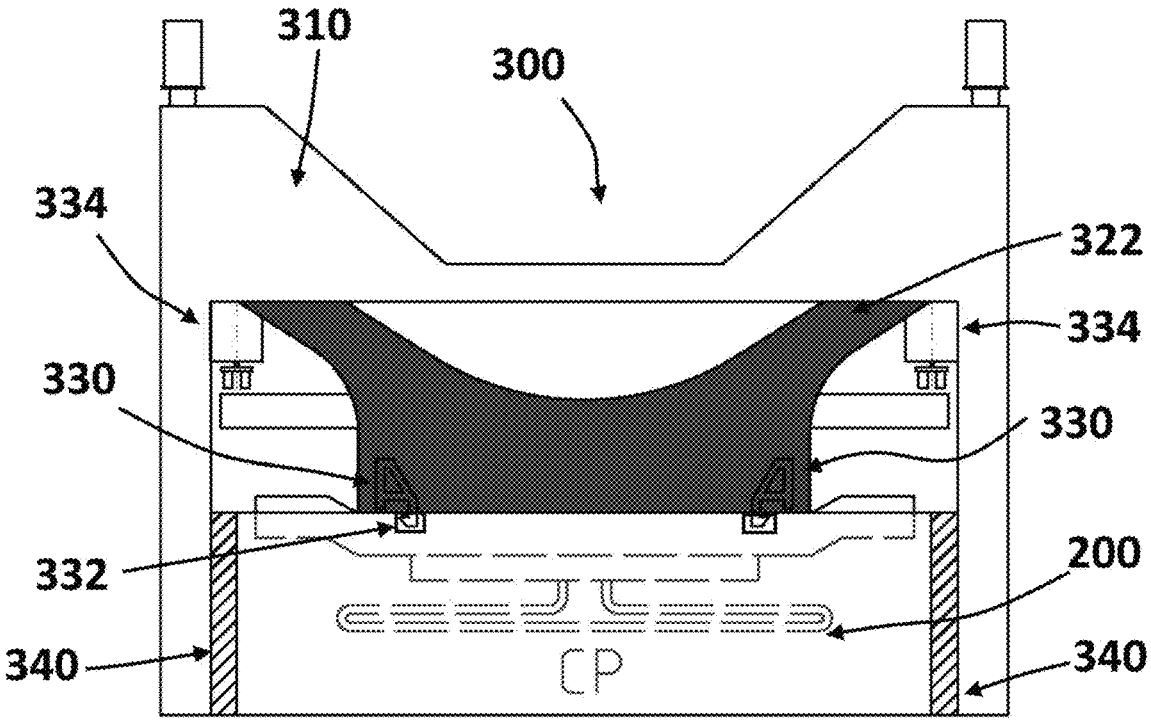
FIG. 26 is a schematic open view of the CPLB in accordance with a preferred embodiment with the handling beam in its insulated position supporting a CP.

As shown on FIGS. 25 and 26, the actuator assembly may further comprise a failsafe hanging device(s) 330 for removably engaging and supporting the cell preheater (FIG. 26) or the anode assembly (FIG. 25). The failsafe hanging device (s) 330 for the CPLB can be the same as the failsafe hanging device(s) 130 of the transfer box as described herein. The failsafe hanging device 330 engages into a corresponding handling pin 332 of the cell preheater 200 or the (spent) anode assembly 50 upon lowering of the actuator assembly onto the cell preheater or anode assembly.

Figure 23:
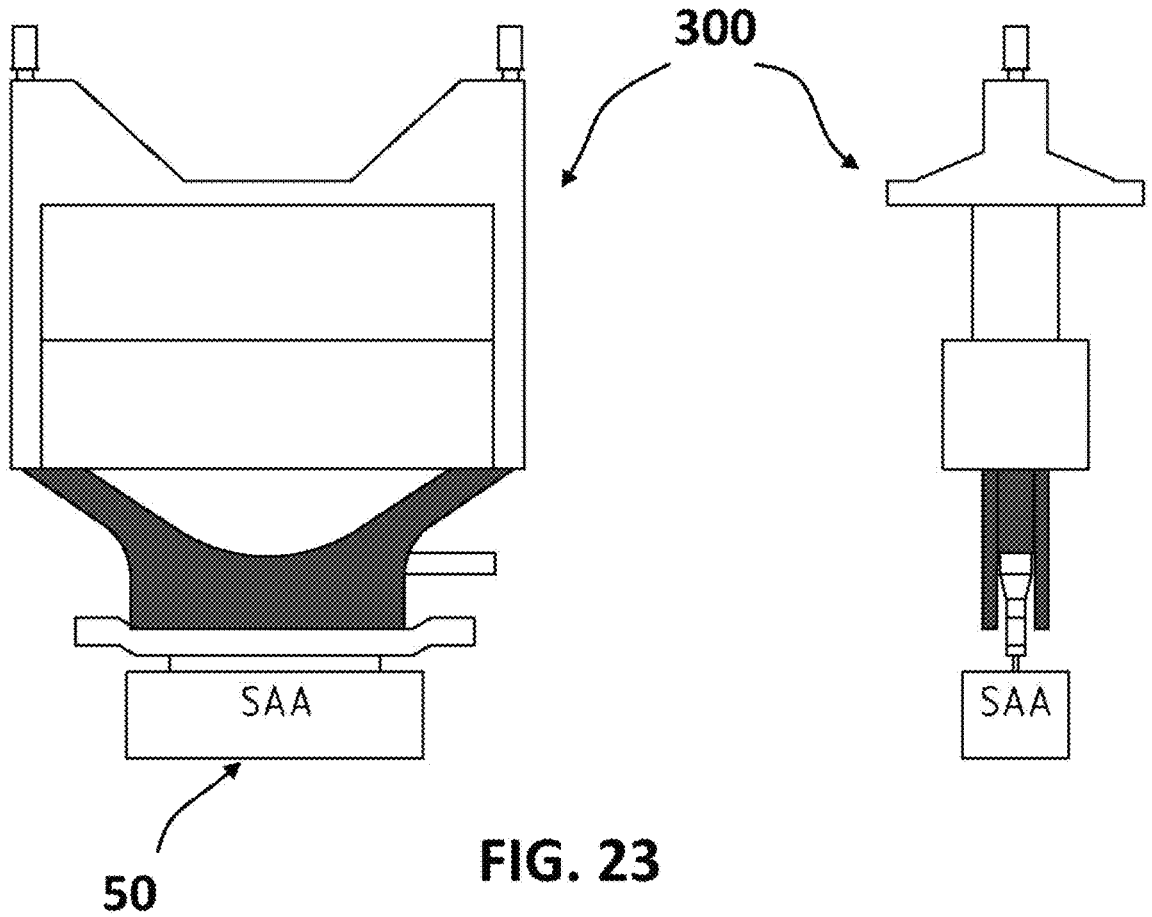
FIG. 23 is a schematic view of the CPLB in accordance with a preferred embodiment showing: (left) the CPLB in its loading-unloading position with a SAA attached to the handling beam, and (right) a lateral view of the same.
Figure 24:
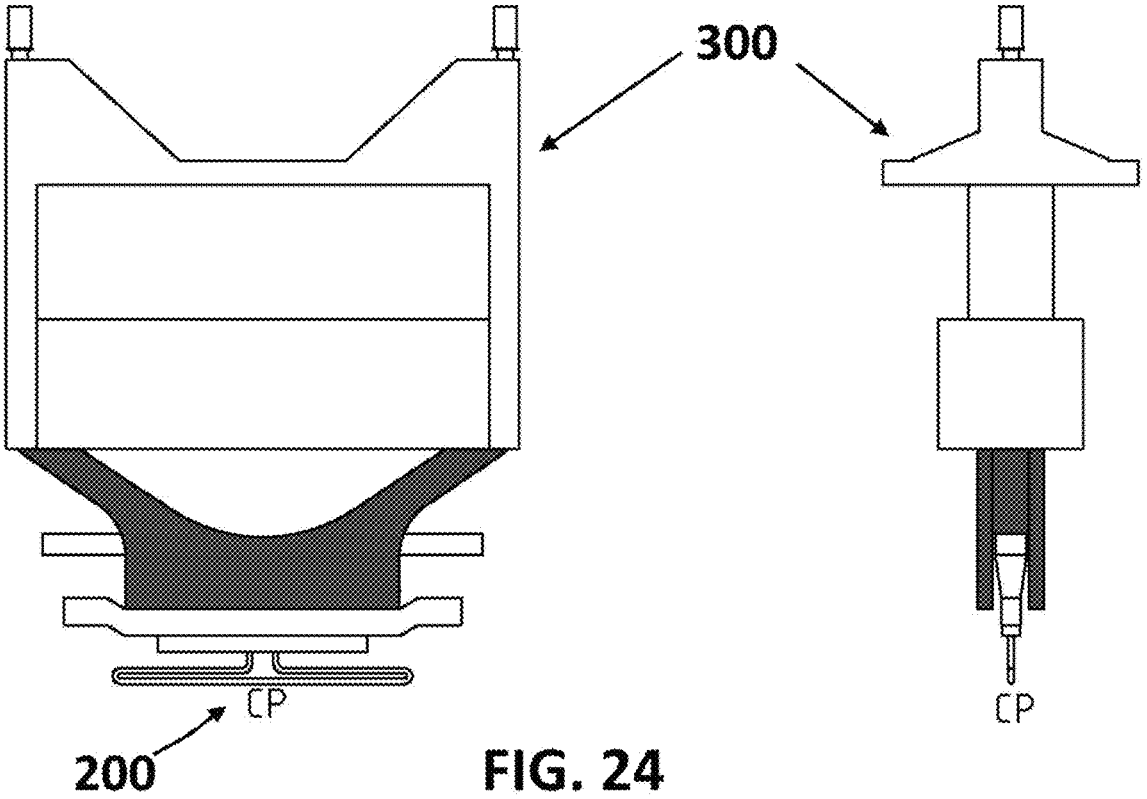
FIG. 24 is a schematic view of the CPLB in accordance with a preferred embodiment showing: (left) the CPLB in its loading-unloading position with a CP attached to the handling beam, and (right) a lateral view of the same.

FIG. 23 is a schematic view of the CPLB 300 in accordance with a preferred embodiment showing the CPLB in its loading-unloading position with a SAA 50 attached to a handling beam 322 of the actuator assembly 320 (left drawing being the front view and right drawing being the side view). FIG. 24 is a schematic view of the CPLB 300 in accordance with a preferred embodiment showing the CPLB 300 in its loading-unloading position with a CP 200 attached to the handling beam (left drawing being the front view and right drawing being the side view). FIG. 25 is a schematic open view of the CPLB 300 in accordance with a preferred embodiment with the handling beam 322 in its insulated position supporting the SAA 50, whereas FIG. 26 is a schematic open view of the CPLB 300 in accordance with a preferred embodiment with the handling beam 322 in its insulated position supporting a CP 200.

As shown on FIGS. 25 and 26, the apparatus or CPLB 300 may further comprising a thermic shelter 340 supported by the supporting structure 310 for protecting the supporting structure from heat irradiating from the cell-preheater or the spent anode assembly when the cell pre-heater or the spent anode assembly are removed from the cell. The thermal shelters may comprise refractory lining. Thermic shelters as described herein above for the transfer box 100 can be used.

Figure 27:
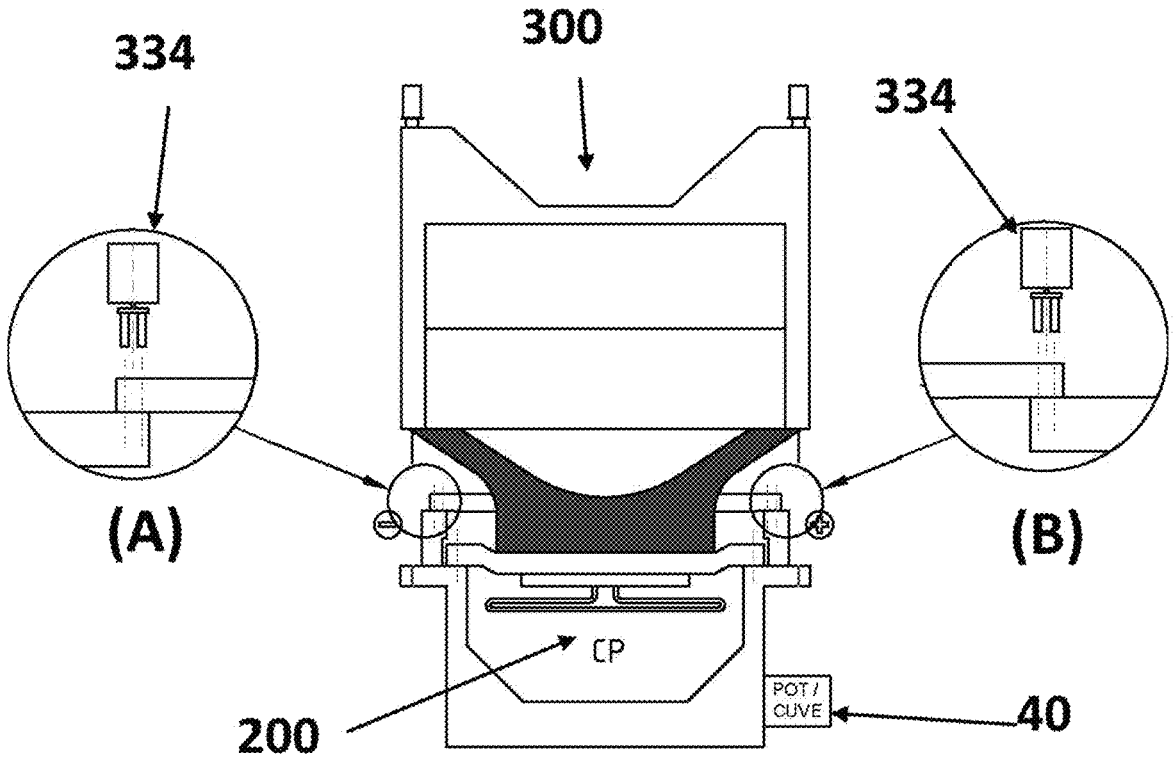
FIG. 27 is a schematic open view of the CPLB supporting a CP over an electrolytic cell with (A) and (B) showing details of a pair of automatic connections of the CPLB with the electrolytic cell in accordance with a preferred embodiment.
Figure 28:
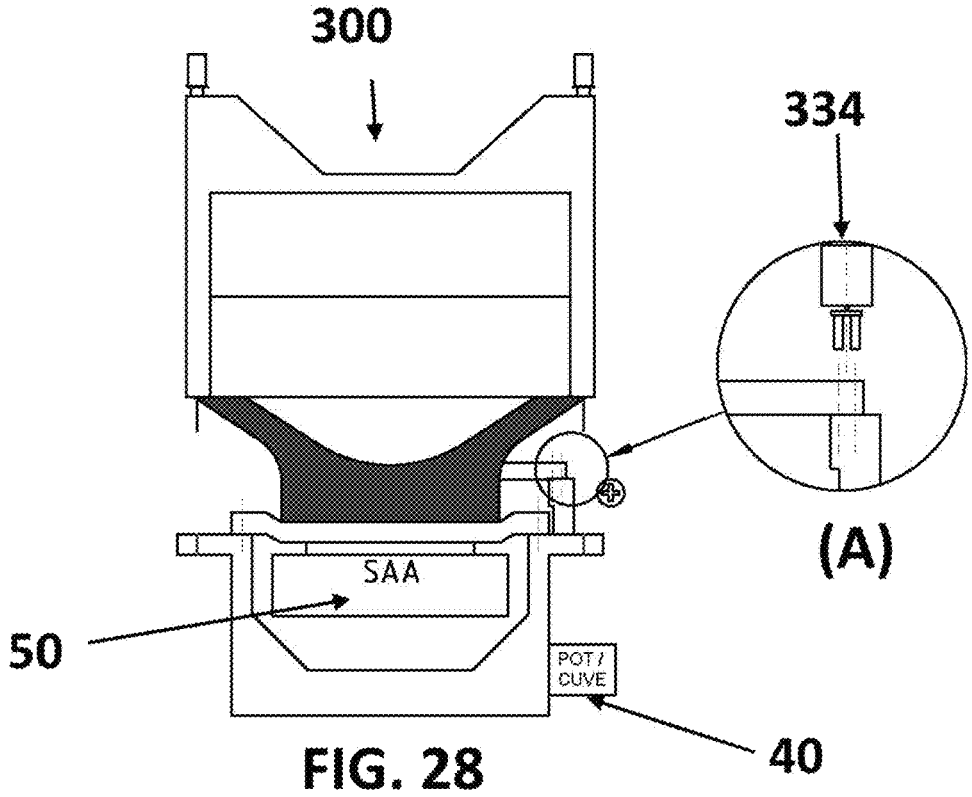
FIG. 28 is a schematic open view of the CPLB supporting a SAA over an electrolytic cell with (A) details of one automatic connection of the CPLB with the electrolytic cell in accordance with a preferred embodiment.

As shown in FIGS. 25 to 28, the CPLB 300 further comprises an automated connecting system 334 configured for electrically connecting the cell pre-heater 200 to the electrolytic cell 40 when the cell preheater is installed into the cell, or electrically disconnecting the cell pre-heater from the electrolytic cell before removing from the cell preheater. The CPLB 300 may have two opposed automated connecting system 334 as shown in FIGS. 25-27, for electrically connecting the CP 200 to the cell 40. FIG. 27 is a schematic open view of the CPLB 300 supporting a CP 200 over an electrolytic cell with (A) and (B) showing details of the pair of automatic connections 334 of the CPLB with the electrolytic cell in accordance with a preferred embodiment. When the CPLB 300 is used for removing and transporting a SAA, only one of the automated connecting systems 334 is used (see FIG. 26), or the CPLB has only one automated connecting system 334 as shown on FIG. 28. FIG. 28 is a schematic open view of the CPLB supporting a SAA over an electrolytic cell with (A) details of one automatic connection of the CPLB with the electrolytic cell in accordance with a preferred embodiment.

As shown on FIG. 25, the supporting structure is configured to permit ventilation of an upper zone 313 of the supporting structure 312 to maintain the upper zone at a lower temperature than a lower hot zone containing the cell-preheater or the spent anodes of the anode assembly. For instance, the upper zone 313 over the beam 322 can be opened allowing for natural ventilation of the upper zone 313.

Methods of Using the CPLB

Figure 30:
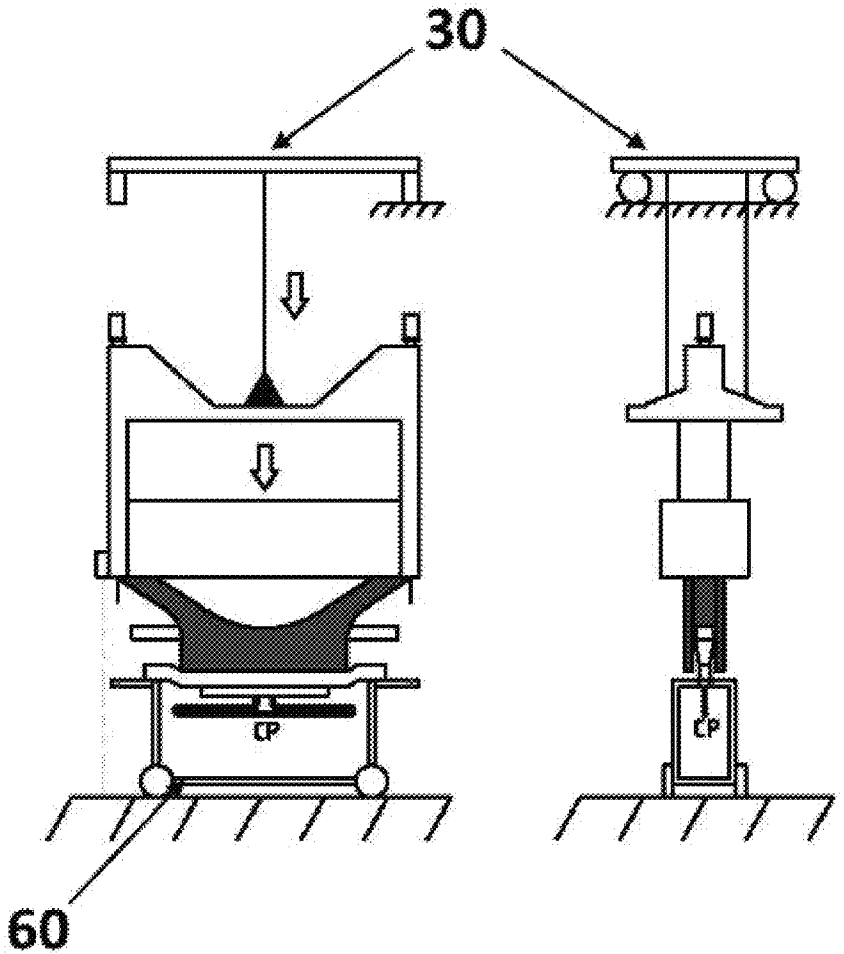
FIG. 30 illustrates the second step of connecting the CPLB to the CP in the chariot in accordance with preferred embodiments, (left) front view, (right) side view.
Figure 29:
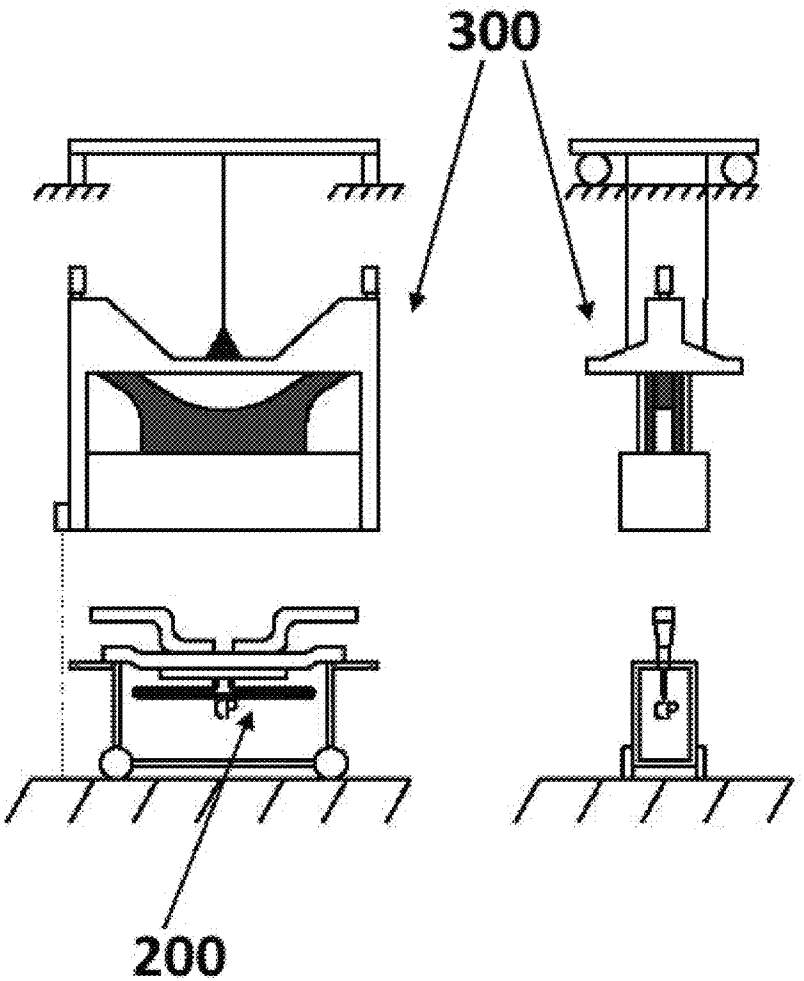
FIG. 29 illustrates the first step of approaching a CPLB over a chariot containing a CP in accordance with preferred embodiments, (left) front view, (right) side view.
Figure 32:
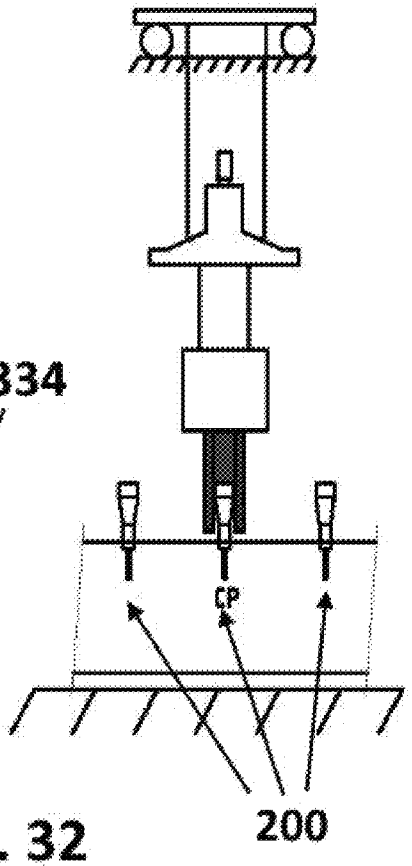
FIG. 32 illustrates the fourth step of lowering the CP from the CPLB positioned over the electrolytic cell with preferred embodiments, (left) front view, (right) side view.
Figure 31:
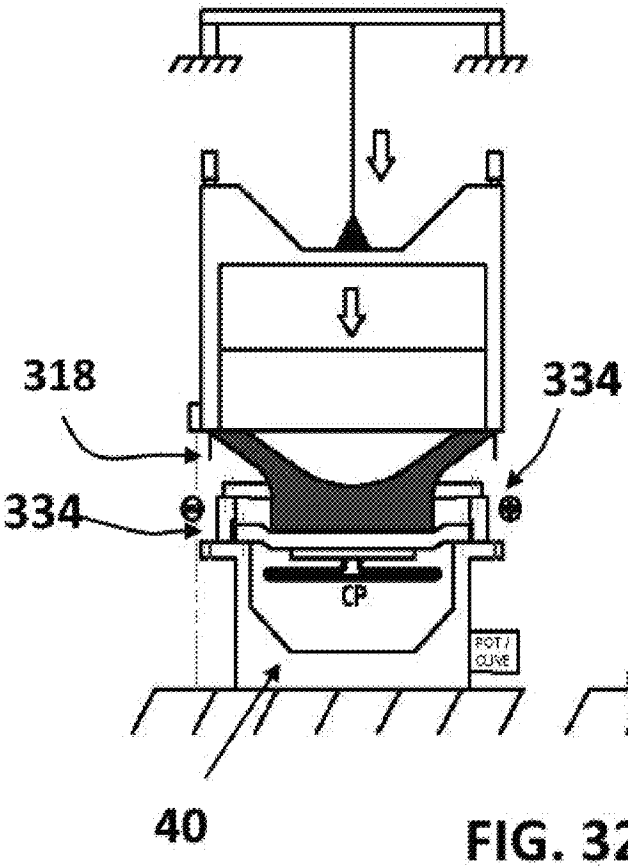
FIG. 31 illustrates the third step of raising the CPLB and the CP from the chariot in accordance with preferred embodiments, (left) front view, (right) side view.
Figure 31:
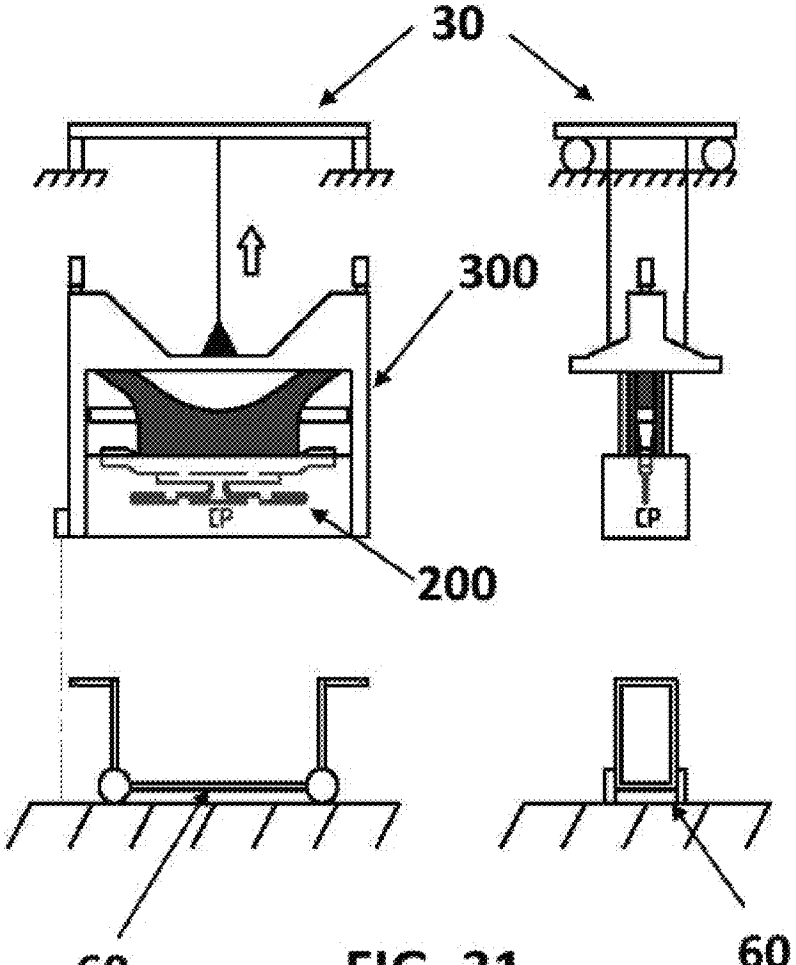
Figure 34:
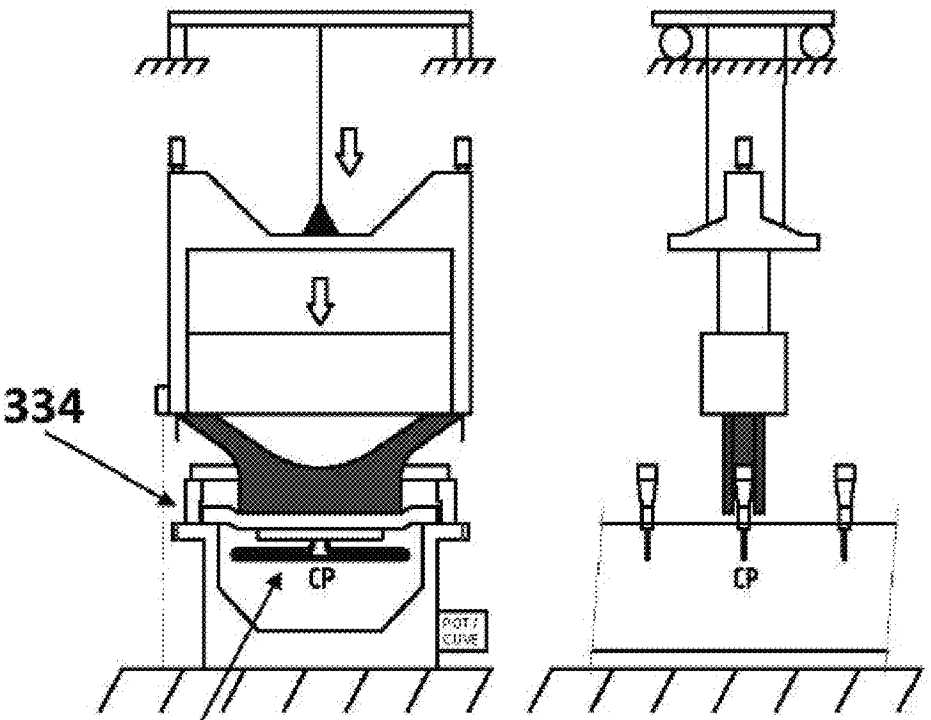
FIG. 34 illustrates the second step of removing the CP from the heated electrolytic cell, in which the handling beam of the CPLB is lowered before connecting with the CP, in accordance with preferred embodiments, (left) front view, (right) side view.

FIGS. 29 to 32 illustrate the different steps of using the CPLB 300 for conveying a CP 200 and installing the same in the cell, with the left drawings showing a front view and the right drawings showing the side view. FIG. 29 illustrates the first step of approaching the CPLB 300 over a chariot 60 containing a CP. FIG. 30 illustrates the second step of connecting the CPLB 300 to the CP 200 in the chariot 60. FIG. 31 illustrates the third step of raising the CPLB 300 and the CP 200 from the chariot 60 before conveying the same toward the cell 40 to be preheated. FIG. 32 illustrates the fourth step of lowering the CP from the CPLB into the electrolytic cell 40, once the CPLB has been positioned over the cell 40. In the second step above, the CPLB is precisely placed over the cell thanks to the guiding pins 318 (FIG. 32). The electrical connections are done by the interactions between the CPLB and the automated connecting system 334 in collaboration with two electric pods. As shown on FIG. 32, the CPLB can be sued to place several CP 200 in the same electrolytic cell.

Figure 33:
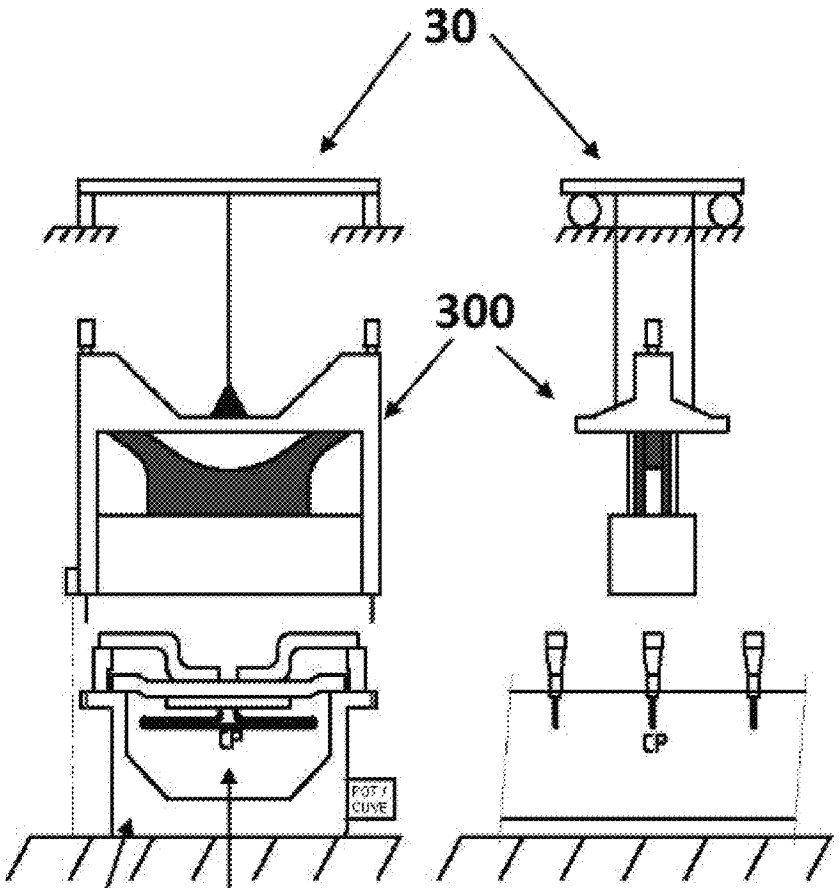
FIG. 33 illustrates the first step of removing a CP from an electrolytic cell, once the cell has been heated by the CP, in which the CPLB is positioned over the electrolytic cell containing the CP in accordance with preferred embodiments, (left) front view, (right) side view.
Figure 36:
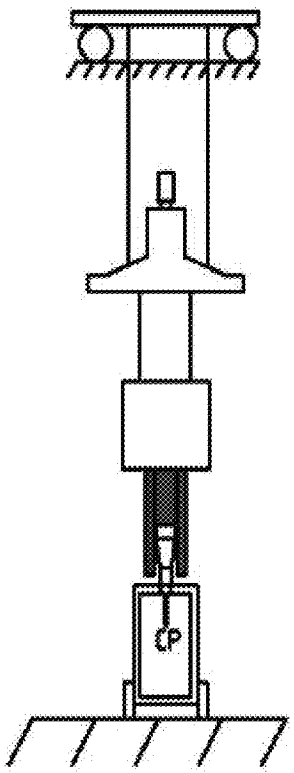
FIG. 36 illustrates the fourth step of lowering and unloading the CP from the CPLB positioned over a chariot in accordance with preferred embodiments, (left) front view, (right) side view.
Figure 36:
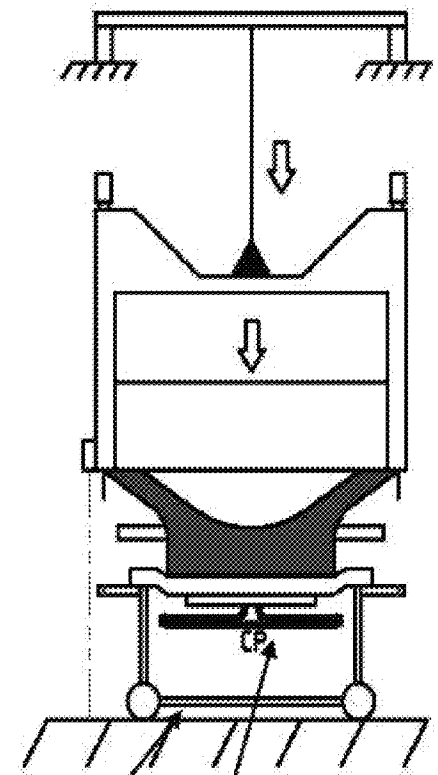
Figure 35:
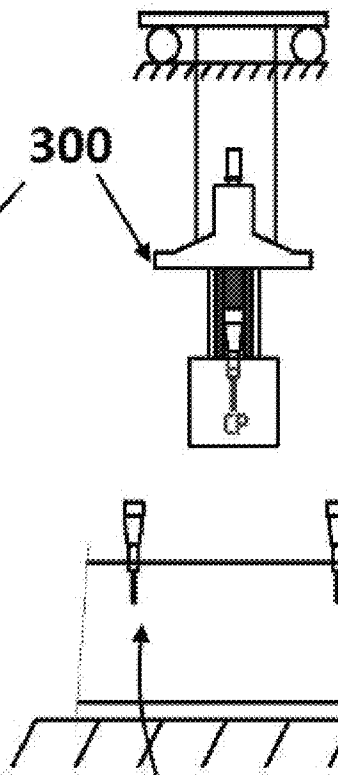
FIG. 35 illustrates the third step of raising the CPLB and the CP from the electrolytic cell in accordance with preferred embodiments, (left) front view, (right) side view.
Figure 35:
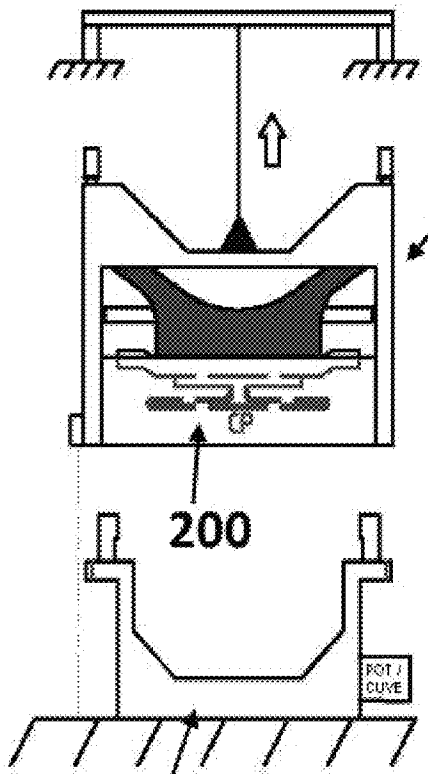

FIGS. 33 to 36 illustrate the different steps of using the CPLB 300 for removing and conveying one or several CPs 200 from the cell once each CP has heated the cell, with the left drawings showing a front view and the right drawings showing the side view. FIG. 33 illustrates the first step of removing the CP 200 from the electrolytic cell 40, once the cell has been heated by the CP. The CPLB 300 is precisely positioned over the electrolytic cell containing the CP with the help of the guiding pins 318. As shown on FIG. 34, the beam 322 moves down until to grab and lock the CP with the failsafe hanging device(s) 330. The two electrical pods are disconnected from the CP using the automated connecting system 334. FIG. 35 illustrates the third step of raising the CPLB and the CP from the electrolytic cell. FIG. 36 illustrates the fourth step of lowering and unloading the CP from the CPLB positioned over a chariot for further conveyance and maintenance.

Figure 38:
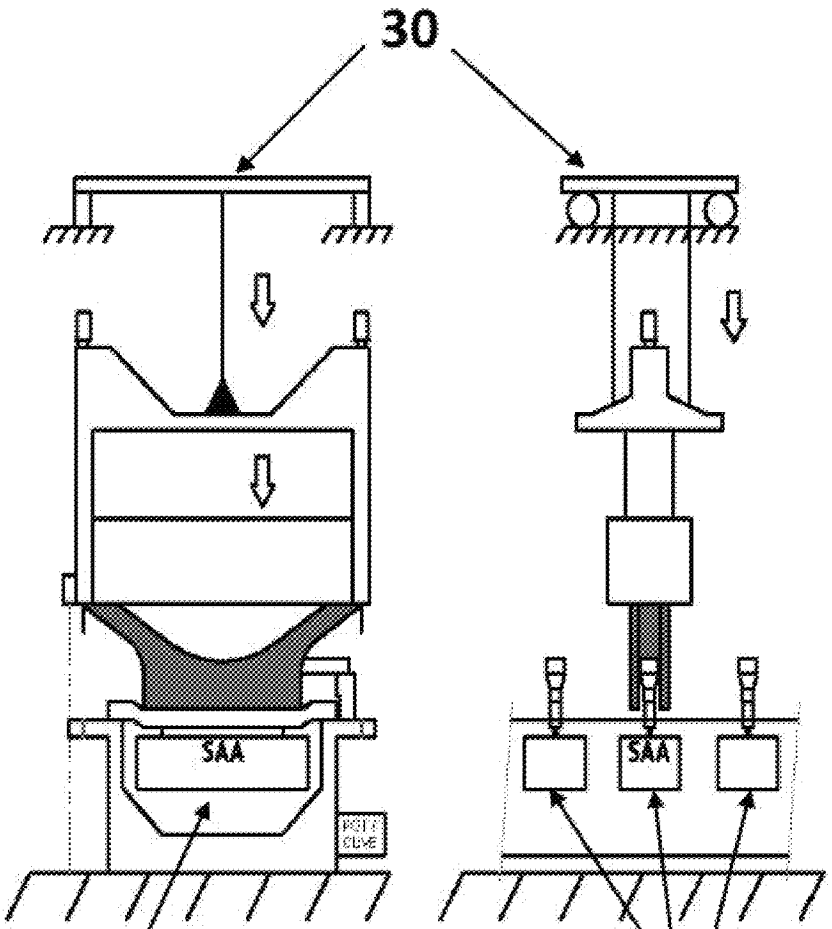
FIG. 38 illustrates the second step of removing the SAA from the electrolytic cell, in which the handling beam of the CPLB is lowered before connecting with the SAA, in accordance with preferred embodiments, (left) front view, (right) side view.
Figure 37:
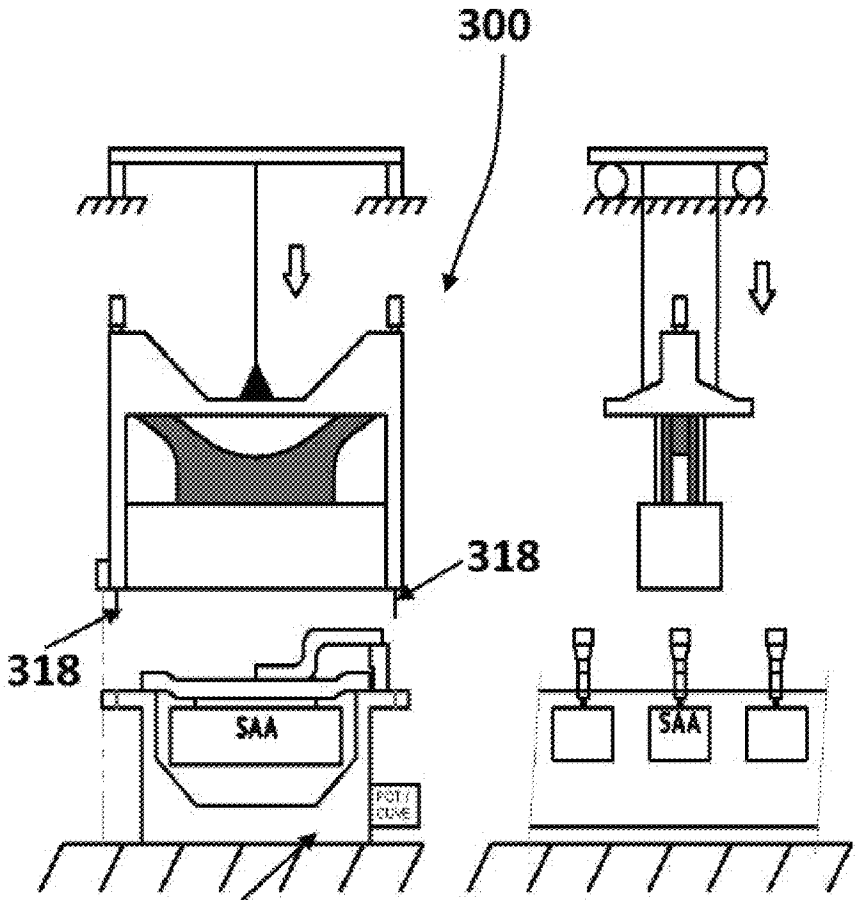
FIG. 37 illustrates the first step of removing a SAA from an electrolytic cell, in which the CPLB is positioned over the electrolytic cell containing the SAA in accordance with preferred embodiments, (left) front view, (right) side view.
Figure 40:
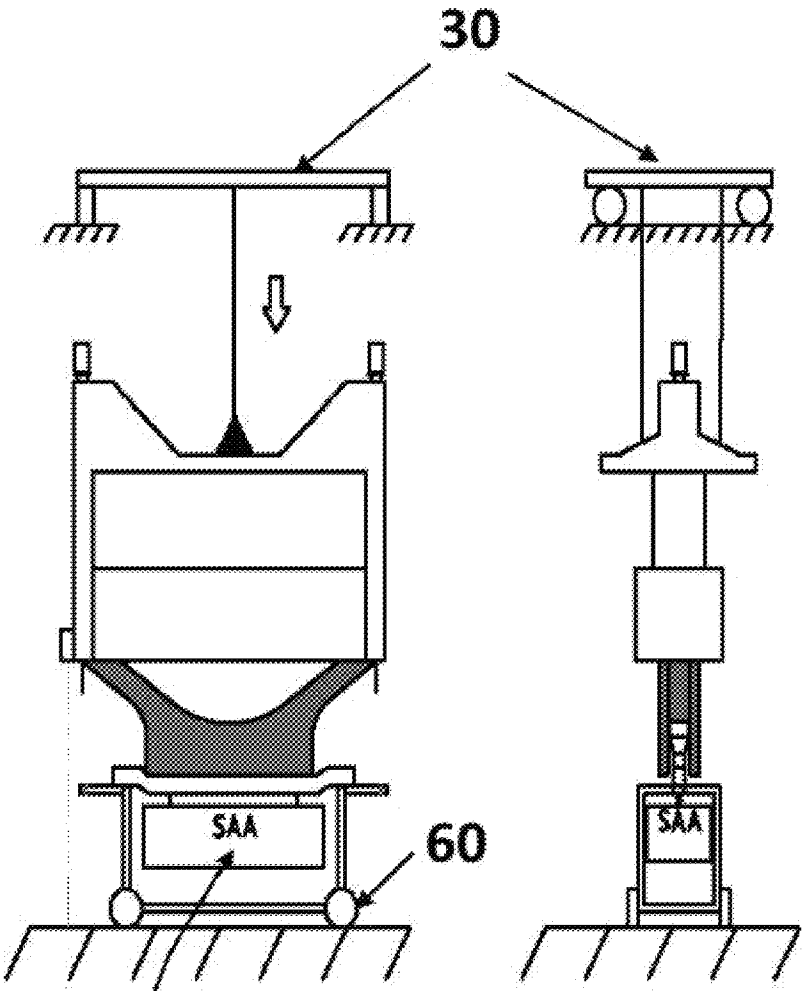
FIG. 40 illustrates the fourth step of positioning the CPLB containing the SAA over a chariot before lowering and unloading the SAA into the chariot in accordance with preferred embodiments, (left) front view, (right) side view.
Figure 39:
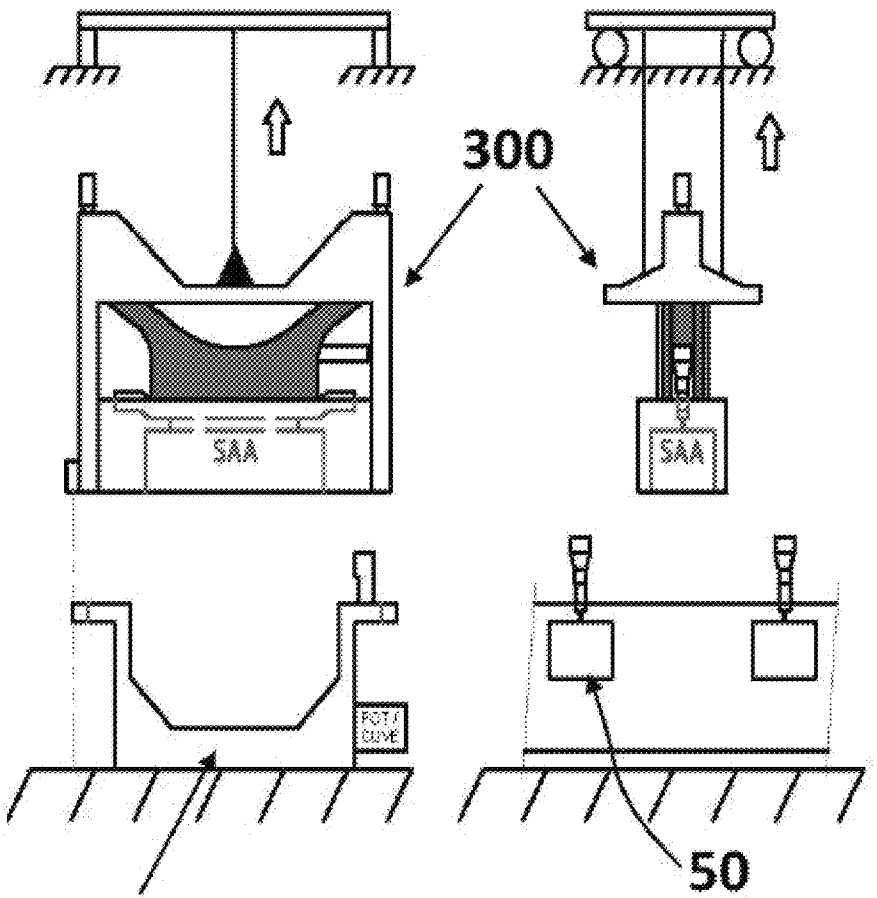
FIG. 39 illustrates the third step of raising the CPLB and the SAA from the electrolytic cell in accordance with preferred embodiments, (left) front view, (right) side view.

FIGS. 37 to 40 illustrate the different steps of using the CPLB 300 for removing a spent anode assembly (SAA) from the cell 40, with the left drawings showing a front view and the right drawings showing the side view. FIG. 37 illustrates the first step during which the CPLB 300 is precisely positioned over the electrolytic cell 40 containing the SAA, using the guiding pins 318. FIG. 38 illustrates the second step of removing the SAA from the electrolytic cell, in which the handling beam 322 of the CPLB 300 is lowered before grabbing and locking the SAA, as described for the CP above. The SAA is electrically disconnected from the cell, as described for the CP above. FIG. 39 illustrates the third step of raising the CPLB 300 and the SAA 50 from the electrolytic cell 40. Finally, FIG. 40 illustrates the fourth step of positioning the CPLB 300 containing the SAA 50 over a chariot 60 before lowering and unloading the SAA into the chariot for further conveyance and maintenance.

Figure 41:
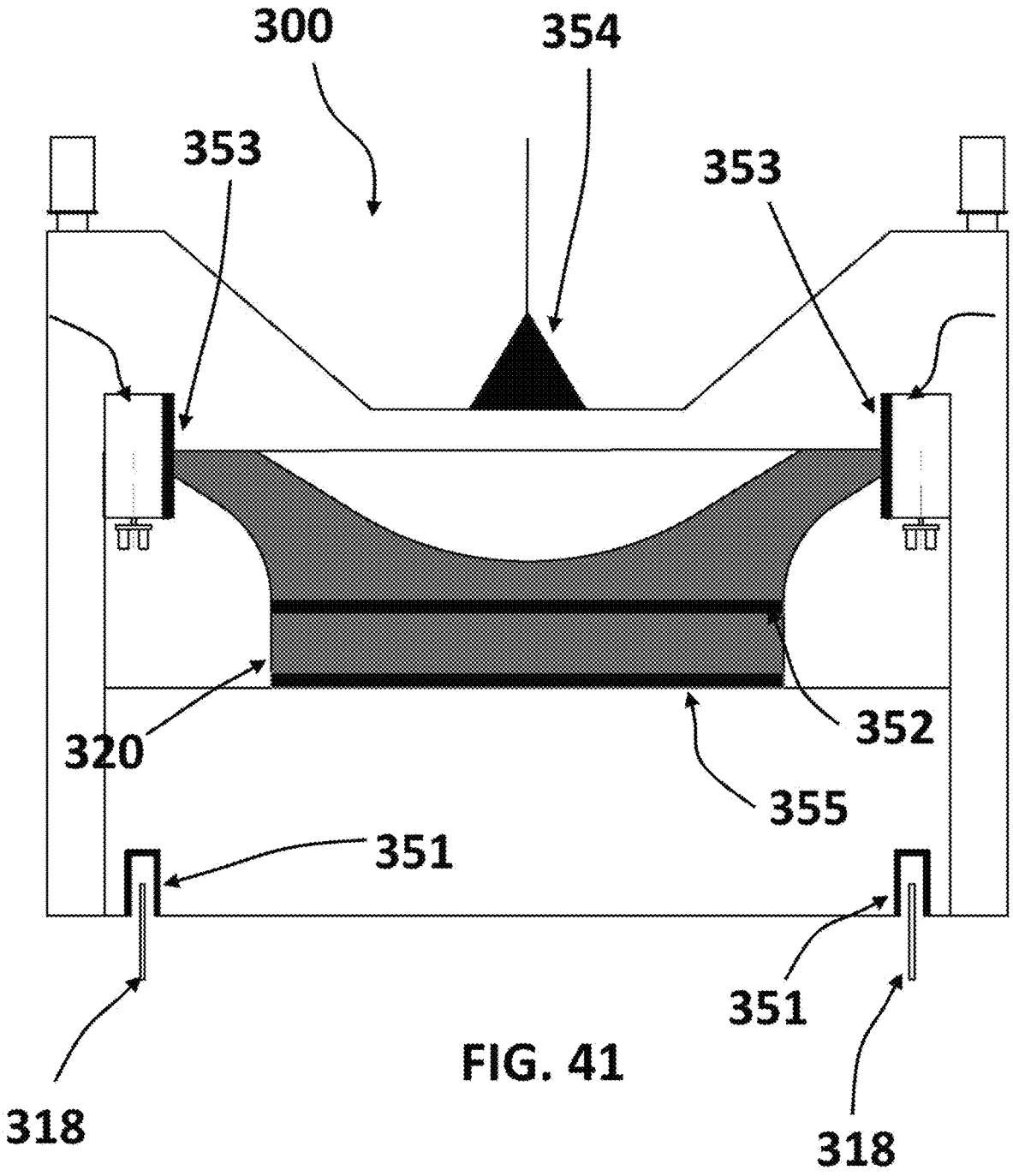
FIG. 41 illustrates different positions of electrical isolating elements of the CPLB in accordance with preferred embodiments.

FIG. 41 illustrates different positions of electrical isolating elements of the CPLB in accordance with preferred embodiments. As for the Transfer Box 100 described herein, electrical isolating elements 351-354 can be located at different positions of the CPLB 300. In particular: a first electrical isolating element 351 can be inserted between the supporting structure 310 and the guiding pins 318, a second electrical isolating element 352 can be inserted on a top portion of the actuator assembly 320, a third electrical isolating element 353 can be inserted between the automatic connection assembly 334 and the supporting structure 310, and a fourth electrical isolating element 354 can be inserted for isolating the transfer box 100 from the crane, for instance in collaboration with an handling hook 360 at the top section of the CPLB. This fourth element 354 can be also part of the main supporting bridge or crane 30 (see e.g. FIG. 40). A fifth electrical isolating elements 355 can be inserted at a bottom surface of the handling beam 322 in order to avoid any electrical contact or short-circuit of the heating resistance of the CP during the connection or disconnection of the handling beam 322.

Combined Uses of the Transfer Box (TB) and the Cell-Preheater Lifting Beam (CPLB) for the Maintenance of an Electrolytic Cell.

Figure 42:
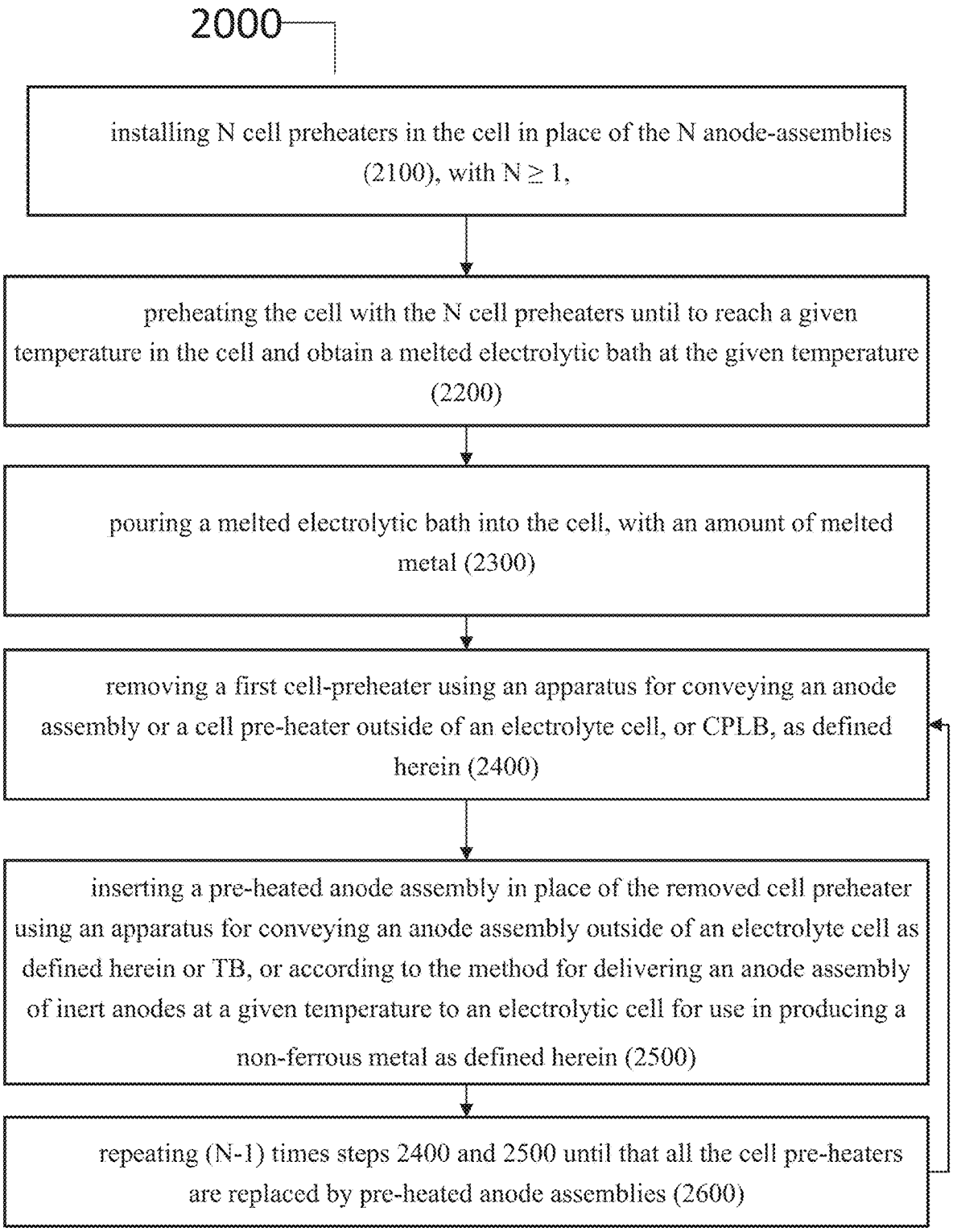
FIG. 42 is a flowchart for illustrating a method for starting up an electrolytic cell for producing a non-ferrous metal according to preferred embodiments.

FIG. 42 is a flowchart for illustrating the method according to preferred embodiments, for the start-up and maintenance of an electrolytic cell for producing a non-ferrous metal, the electrolytic cell being configured to contain a number N of anode assemblies, with N≥1. Typically, a cell may contain up to 17 anode assemblies.

The method 2000 comprises:

a) installing N cell preheaters in the cell in place of the N anode-assemblies 2100;

b) preheating the cell with the N cell preheaters until to reach a given temperature in the cell 2200;

c) pouring a melted electrolytic bath into the cell and optionally a portion of melted metal 2300;

d) removing a first cell-preheater using an apparatus for conveying an anode assembly or a cell pre-heater outside of an electrolyte cell, or CPLB, as defined herein 2400;

e) inserting a pre-heated anode assembly in place of the removed cell preheater using an apparatus for conveying an anode assembly outside of an electrolyte cell as defined herein or TB, or according to the method for delivering an anode assembly of inert anodes at a given temperature to an electrolytic cell for use in producing a non-ferrous metal as defined herein 2500, and f) repeating (N−1) times steps d) 2400 and e) 2500 until that all the cell pre-heaters are replaced by pre-heated anode assemblies 2600.

Figure 43:
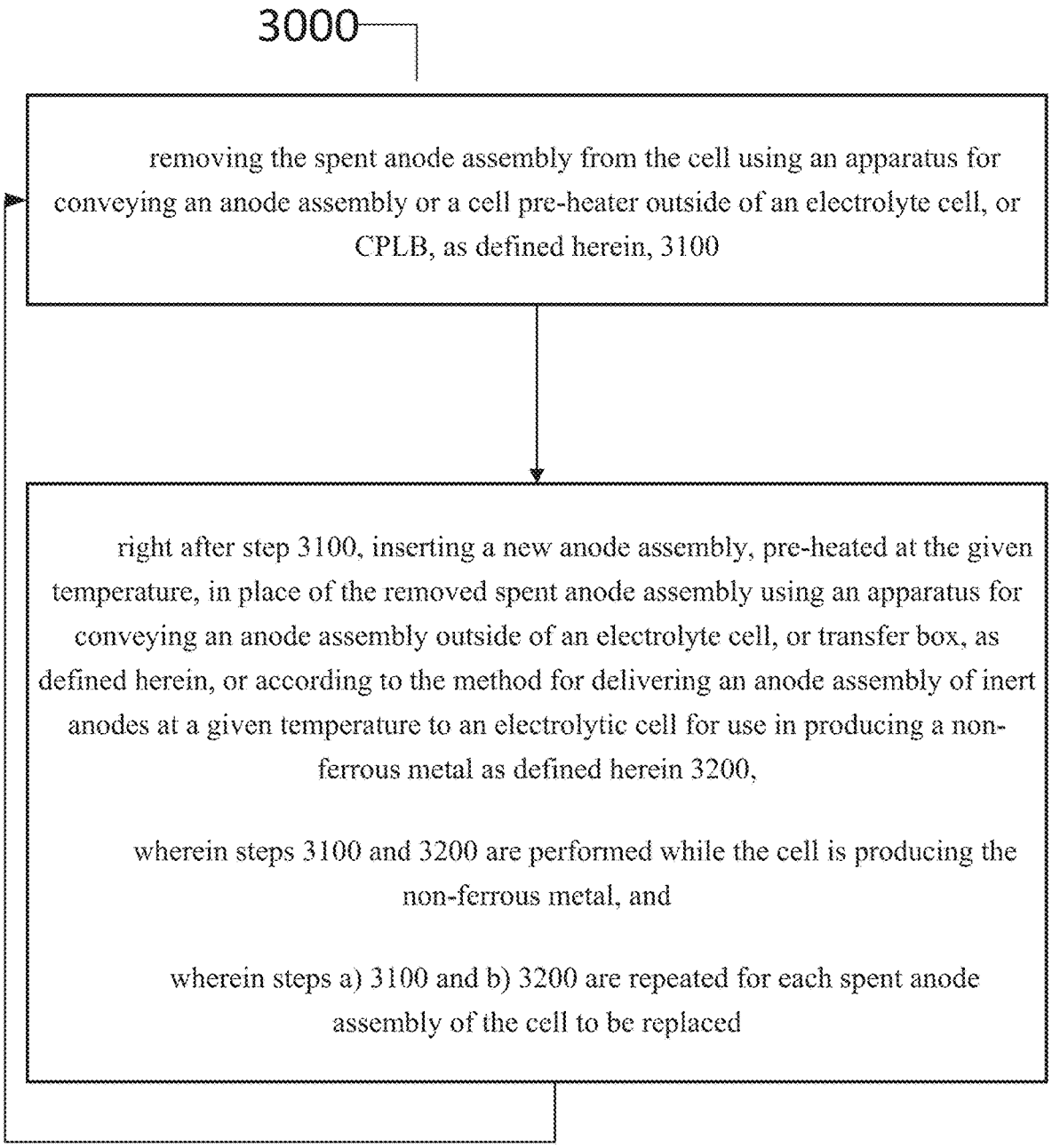
FIG. 43 is a flowchart for illustrating a method for the replacement of a spent anode assembly of an electrolytic cell during the production a non-ferrous metal, according to preferred embodiments.

FIG. 43 is a flowchart for illustrating the method according to preferred embodiments, for the replacement of a spent anode assembly of an electrolytic cell during the production a non-ferrous metal, the cell comprising N anode assemblies, with N≥1, plunged into a melted electrolytic bath at a given temperature. Typically, the given temperature when the electrolyte bath comprises alumina for the making of aluminum is from 750 to 1000° C., for instance about 850° C.

The method 3000 comprises:

a) removing the spent anode assembly from the cell using an apparatus for conveying an anode assembly or a cell pre-heater outside of an electrolyte cell, or CPLB, as defined herein, 3100; and b) right after step a), inserting a new anode assembly, pre-heated at the given temperature, in place of the removed spent anode assembly using an apparatus for conveying an anode assembly outside of an electrolyte cell, or transfer box, as defined herein, or according to the method for delivering an anode assembly of inert anodes at a given temperature to an electrolytic cell for use in producing a non-ferrous metal, as defined herein 3200;

wherein steps a) and b) are performed while the cell is producing the non-ferrous metal, and wherein steps a) and b) are repeated for each spent anode assembly of the cell to be replaced.

According to a preferred embodiment of the methods 2000-3000 the non-ferrous metal is aluminum, and the N anode assemblies comprises a plurality of inert anodes. More preferably, the inert anodes are vertical inert anodes.

Advantageously, the thermal supporting of the transfer apparatus or transfer box (TB) allows maintaining the anode temperature homogeneity and preventing the thermal shock when introducing the inert anodes into the hot electrolytic bath.

Existing solution used for the traditional Hall-Heroult process is not applicable to the inert anode process due do the different configuration of the cell and of the anode assembly. Furthermore, it does not answer the constraint linked with prevention of the thermal shock on the anode. The present invention is compatible with the inert anode cell and anode assembly configuration and it solves the issue of thermal shock.

Furthermore, the TB and the CPLB according to the present invention are advantageously used conjointly to operate the electrolytic cells, for the starting up of the cell using cell pre-heaters, and the accurate insertion of pre-heated anode assemblies in place of the cell-preheaters, while preserving the temperature of the cell and the heated anode assemblies, avoiding as such thermal shocks. The TB and the CPLB according to the present invention are advantageously used conjointly to replace a spent anode assembly by a new pre-heated anode assembly while keeping the other anode assemblies of the cell producing the non ferrous-metal. The TB allows fast and accurate mechanical and electrical connections of the anode assembly in the cell, which is an important requirement when inert or oxygen evolving anodes are in use for a long period of time compared to consumable anodes, such as carbon anodes. The CPLB allows fast and precise installation of the cell preheaters in the cell, and also fast and safe removal of the cell pre-heaters or spent anode assembly.

The description of the present invention has been presented for purposes of illustration but is not intended to be exhaustive or limited to the disclosed embodiments. Many modifications and variations will be apparent to those of ordinary skill in the art. The embodiments were chosen to explain the principles of the invention and its practical applications and to enable others of ordinary skill in the art to understand the invention in order to implement various embodiments with various modifications as might be suited to other contemplated uses.

What is claimed is:

1. An apparatus for conveying a spent anode assembly or a cell pre-heater outside of an electrolyte cell, the cell pre-heater being configured to be inserted in the electrolyte cell for pre-heating the electrolyte cell before inserting a pre-heated anode assembly in the pre-heated cell, the apparatus comprising:

a supporting structure, defining an interior space;

an actuator assembly coupled with the supporting structure and configured to support the spent anode assembly or the cell pre-heater, the actuator assembly being operable to move the spent anode assembly or the cell pre-heater between:

an insulated position wherein the spent anode assembly or the cell pre-heater is positioned in the interior space of the supporting structure; and a loading-unloading position wherein the spent anode assembly or the cell pre-heater is outside the supporting structure for loading the spent anode assembly or the cell pre-heater to the actuator assembly or unloading the spent anode assembly or the cell pre-heater from the actuator assembly; and an automated connecting system configured for electrically connecting the cell pre-heater to the electrolytic cell when the cell pre-heater is installed into the cell, or electrically disconnecting the spent anode assembly or the cell pre-heater from the electrolytic cell before removing them from the cell pre-heater.

2. The apparatus according to claim 1, wherein the actuator assembly further comprises an electric insulation system for electrically isolating the cell pre-heater or the spent anode assembly from the actuator assembly.

3. The apparatus according to claim 1, wherein the actuator assembly comprises a handling horizontal beam configured to removably connect to the spent anode assembly and to vertically move the cell pre-heater or the spent anode assembly inside the interior space.

4. The apparatus according to claim 3, wherein the actuator assembly comprises a first motor and a second motor supported by the supporting structure, each motor being respectively coupled to a moving element arranged at opposite longitudinal ends of the handling beam along which the handling beam is vertically raised and lowered.

5. The apparatus according to claim 4, wherein the moving element comprises a threaded rod or a chain activated by the motor for raising or lowering the handling beam.

6. The apparatus according to claim 1, wherein the actuator assembly comprises a failsafe hanging device for removably engaging and supporting the cell pre-heater or the spent anode assembly.

7. The apparatus according to claim 6, wherein the failsafe hanging device engages into a corresponding handling pin of the cell pre-heater or the spent anode assembly upon lowering of the actuator assembly onto the cell pre-heater or the spent anode assembly.

8. The apparatus according to claim 1, further comprising a thermic shelter supported by the supporting structure for protecting the supporting structure from heat irradiating from the cell pre-heater or the spent anode assembly when the cell pre-heater or the spent anode assembly are removed from the cell.

9. The apparatus according to claim 8, wherein the thermal shelter comprises a refractory lining.

10. The apparatus according to claim 1, wherein the supporting structure is configured to permit ventilation of an upper zone of the supporting structure to maintain the upper zone at a lower temperature than a lower hot zone containing the cell pre-heater or anodes of the spent anode assembly.

11. The apparatus according to claim 1, further comprising guiding pins which register with a structure of the electrolyte cell for facilitating operative installation of the cell pre-heater or the spent anode assembly thereinto.

12. The apparatus according to claim 1, wherein the automated connection assembly comprises a pair of pneumatic wrench and synchronised bolting system.

13. The apparatus according to claim 1, wherein the supporting structure comprises an attaching element which is configured to be mechanically attached to an overhead crane for transporting the apparatus.

14. A method for starting up an electrolytic cell for producing a non-ferrous metal, the electrolytic cell being configured to contain a number N of anode assemblies, with N≥1, the method comprising:

a) installing N cell pre-heaters in the electrolytic cell in place of the N anode-assemblies;

b) pre-heating the electrolytic cell with the N cell pre-heaters until given temperature is reached in the electrolytic cell;

c) pouring a melted electrolytic bath into the cell, with an amount of melted metal;

d) removing a first cell pre-heater using the apparatus for conveying a spent anode assembly or a cell pre-heater outside of an electrolyte cell as defined in claim 1;

e) inserting a pre-heated anode assembly in place of the removed cell pre-heater; and f) repeating (N−1) times steps d) and e) until all of the N cell pre-heaters are replaced by pre-heated anode assemblies.

15. The method of claim 14, wherein the non-ferrous metal to be produced is aluminum, and the N pre-heated anode assemblies comprise a plurality of vertically oriented inert anodes.

16. The method of claim 14, wherein step e) is performed using an insulating apparatus for maintaining and conveying the pre-heated anode assembly outside of the electrolyte cell, the anode assembly comprising a plurality of vertically oriented inert anodes, and wherein the insulating apparatus comprises:

a supporting structure, defining an interior space, for insulating the anode assembly when in the interior space;

an actuator assembly coupled with the supporting structure and configured to support the anode assembly, the actuator assembly being operable to move the anode assembly between:

an insulated position wherein the anode assembly is positioned in the interior space of the supporting structure; and a loading-unloading position wherein the anode assembly is outside the supporting structure for loading the anode assembly to the actuator assembly and unloading the anode assembly from the actuator assembly; and a thermal shelter assembly extending from an interior surface of the supporting structure for insulating the anode assembly when the anode assembly is in the interior space.

17. A method for the replacement of a spent anode assembly of an electrolytic cell during the production a non-ferrous metal, the cell comprising N anode assemblies, with N≥1, plunged into a melted electrolytic bath at a given temperature, the method comprising:

a) removing the spent anode assembly from the cell using the apparatus for conveying a spent anode assembly or a cell pre-heater outside of an electrolyte cell as defined in claim 1;

b) right after step a), inserting a new anode assembly, pre-heated at the given temperature, in place of the removed spent anode assembly;

wherein steps a) and b) are performed while the cell is producing the non-ferrous metal, and wherein steps a) and b) are repeated for each spent anode assembly of the cell to be replaced.

18. The method of claim 17, wherein the non-ferrous metal is aluminum, and the N anode assemblies comprises a plurality of vertically oriented inert anodes.

19. The method of claim 17, wherein step b) is performed using an insulating apparatus for maintaining and conveying the pre-heated anode assembly outside of the electrolyte cell, the anode assembly comprising a plurality of vertically oriented inert anodes, and wherein the insulating apparatus comprises:

a supporting structure, defining an interior space, for insulating the anode assembly when in the interior space;

an actuator assembly coupled with the supporting structure and configured to support the anode assembly, the actuator assembly being operable to move the anode assembly between:

an insulated position wherein the anode assembly is positioned in the interior space of the supporting structure; and a loading-unloading position wherein the anode assembly is outside the supporting structure for loading the anode assembly to the actuator assembly and unloading the anode assembly from the actuator assembly; and a thermal shelter assembly extending from an interior surface of the supporting structure for insulating the anode assembly when the anode assembly is in the interior space.

20. The method of claim 19, further comprising heating the inert anodes with an electrical heater module when the anode assembly is in the interior space of the insulating apparatus.

* * * * *